US005272048A

United States Patent [19]

Kim et al.

[11] Patent Number: 5,272,048

[45] Date of Patent: Dec. 21, 1993

[54] REVERSAL PHOTOGRAPHIC ELEMENTS CONTAINING TABULAR GRAIN EMULSIONS

[75] Inventors: Sang H. Kim, Pittsford; Mamie Kam-Ng; Allen K. Tsaur, both of Fairport; Jacob I. Cohen, Rochester; Richard A. Demauriac, Victor; George H. Hawks, III; John D. Baloga, both of Rochester, all of N.Y.

[73] Assignee: Eastman Kodak Company, Rochester, N.Y.

[21] Appl. No.: 846,306

[22] Filed: Mar. 4, 1992

Related U.S. Application Data

[63] Continuation-in-part of Ser. No. 699,869, May 14, 1991, abandoned.

[51] Int. Cl.[5] ..... G03C 1/46; G03C 1/035

[52] U.S. Cl. ..... 430/503; 430/567; 430/569

[58] Field of Search ..... 430/567, 569, 503

[56] References Cited

U.S. PATENT DOCUMENTS

| | | | |
|---|---|---|---|
| 4,582,781 | 4/1986 | Chen et al. | 430/527 |
| 4,656,122 | 4/1987 | Sowinski | 430/505 |
| 4,797,354 | 1/1989 | Saitou | 430/567 |
| 4,977,074 | 12/1990 | Saitou et al. | 430/567 |
| 5,043,259 | 8/1991 | Arai | 430/569 |
| 5,059,517 | 10/1991 | Ihama et al. | 430/567 |
| 5,096,806 | 3/1992 | Nakamura et al. | 430/567 |

FOREIGN PATENT DOCUMENTS 808228 1/1959 United Kingdom .

OTHER PUBLICATIONS

*Research Disclosure*, vol. 232, Aug. 1983, Item 23212.

*Research Disclosure*, vol. 253, May 1985, Item 25330.

*Primary Examiner*—Janet C. Baxter

*Attorney, Agent, or Firm*—Carl O. Thomas

[57] ABSTRACT

A multicolor photographic element capable of forming a viewable reversal dye image is disclosed comprising a support and, coated on the support, a blue recording yellow dye image forming layer unit, a green recording magenta dye image forming layer unit, and a red recording cyan dye image forming layer unit, each of the layer units containing in at least one layer a silver halide emulsion having a grain halide content of from 0 to 5 mole percent chloride, from. 0.5 to 20 mole percent iodide, and from 80 to 99.5 mole percent bromide, based on total silver.

The photographic element is characterized in that at least one of the silver halide emulsion layers is a tabular grain emulsion layer in which the coefficient of variation of the tabular grain emulsion is less than 15 percent, based on the total grain population of the emulsion, and the total grain population of the tabular emulsion consists essentially of tabular grains having a mean thickness of less than 0.3 μm and a mean tabularity of greater than 25.

29 Claims, No Drawings

REVERSAL PHOTOGRAPHIC ELEMENTS CONTAINING TABULAR GRAIN EMULSIONS

This is a continuation-in-part of U.S. Ser. No. 699,869, filed May 14, 1991, now abandoned.

FIELD OF THE INVENTION

The invention relates to improved photographic elements adapted for producing reversal dye images. More specifically, the invention relates to an improved dye image reversal photographic elements containing tabular grain emulsions.

BACKGROUND

The term "reversal photographic element" designates a photographic element which produces a photographic image for viewing by being imagewise exposed and developed to produce a negative of the image to be viewed, followed by uniform exposure and/or fogging of residual silver halide and processing to produce a second, viewable image. Color slides, such as those produced from Kodachrom TM and Ektachrome TM films, constitute a popular example of reversal photographic elements. In the overwhelming majority of applications the first image is negative and the second image is positive.

Although tabular grains had been observed in silver bromide and bromoiodide photographic emulsions dating from the earliest observations of magnified grains and grain replicas, it was not until the early 1980's that photographic advantages, such as improved speed-granularity relationships, more rapid developability, increased thermal stability, increased separation of blue and minus blue imaging speeds, and improved image sharpness in both mono- and multi-emulsion layer formats, were realized to be attainable from silver halide emulsions in which the majority of the total grain population based on grain projected area is accounted for by tabular grains satisfying the mean tabularity (T) relationship:

$$D/t^2>25$$

where

D is the equivalent circular diameter (ECD) in micrometers of the tabular grains and t is the thickness in micrometers of the tabular grains.

Once photographic advantages were demonstrated with tabular grain silver bromide and bromoiodide emulsions techniques were devised to prepare tabular grains containing silver chloride alone or in combination with other silver halides.

Notwithstanding the many established advantages of tabular grain emulsions, the art has observed that these emulsions tend toward more disperse grain populations than can be achieved in the preparation of regular, untwinned grain populations—e.g., cubes, octahedra and cubo-octahedral grains. This has been a concern in some, but not all, photographic applications for tabular grain emulsions.

In the earliest tabular grain emulsions dispersity concerns were largely focused on the presence of significant populations of nonconforming grain shapes among the tabular grains conforming to the aim grain structure. While the presence of nonconforming grain shapes in tabular grain emulsions has continued to detract from achieving narrow grain dispersities, as procedures for preparing tabular grains have been improved to reduce the inadvertent inclusion of nonconforming grain shapes, interest has increased in reducing the dispersity of the tabular grains.

A technique for quantifying grain dispersity that has been applied to both nontabular and tabular grain emulsions is to obtain a statistically significant sampling of the individual grain projected areas, calculate the corresponding ECD of each grain, determine the standard deviation of the grain ECDs, divide the standard deviation of the grain population by the mean ECD of the grains sampled and multiply by 100 to obtain the coefficient of variation (COV) of the grain population as a percentage. While very highly monodisperse (COV<10 percent) emulsions containing regular nontabular grains can be obtained, even the most carefully controlled precipitations of tabular grain emulsions have rarely achieved a COV of less than 20 percent. *Research Disclosure,* vol. 232, Aug. 1983, Item 23212 (Mignot French Patent 2,534,036, corresponding) discloses the preparation of silver bromide tabular grain emulsions with COVs ranging down to 15. *Research Disclosure* is published by Kenneth Mason Publications, Ltd., Dudley Annex, 21a North Street, Emsworth, Hampshire P010 7DQ, England.

Saitou et al U.S. Pat. No. 4,797,354 reports in Example 9 a COV of 11.1 percent; however, this number is not comparable to that reported by Mignot. Saitou et al is reporting only the COV within a selected tabular grain population. Excluded from these COV calculations is the nonconforming grain population within the emulsion, which, of course, is the grain population that has the maximum impact on increasing grain dispersity and overall COV. When the total grain populations of the Saitou et al emulsions are sampled, significantly increased COVs (well in excess of 20%) result.

Techniques for quantitatively evaluating emulsion grain dispersity originally developed for nontabular grain emulsions and later applied to tabular grain emulsions provide a measure of the dispersity of ECDs. Given the essentially isometric shapes of most nontabular grains, dispersity measurements based on ECDs were determinative. As first the nonconforming grain populations and then the diameter dispersity of the tabular grains themselves have been restricted in tabular grain emulsions, those skilled in the art have begun to address now a third variance parameter of tabular grain emulsions which, unlike the first two, is not addressed by COV measurements. The importance of controlling variances in the thicknesses of tabular grains has been gradually realized. It is theoretically possible, for example, to have two tabular grain emulsions with the same measured COV that nevertheless differ significantly in grain to grain variances, since COVs are based exclusively on the ECDs of the tabular grains and do not take variances in grain thicknesses into account.

Although not developed to the level of a quantitative statistical measurement technique, those precipitating tabular grain emulsions have observed that the thickness dispersity of tabular grain emulsions can be visually observed and qualitatively compared as a function of their differing grain reflectances. When white light is directed toward a tabular grain population observed through a microscope, the light reflected from each tabular grain is reflected from its upper and lower major crystal faces. By traveling a slightly greater distance (twice the thickness of a tabular grain) light reflected from a bottom major crystal surface is phase shifted with respect to that reflected from a top major crystal surface. Phase shifting reduces the observed reflection of differing wavelengths to differing degrees, resulting in tabular grains of differing wavelengths exhibiting differing hues. An illustration of this effect is provided in *Research Disclosure*, Vol. 253, May 1985, Item 25330. In the tabular grain thickness range of from about 0.08 to 0.30 μm distinct differences in hue of reflected light are often visually detectable with thickness differences of 0.01 μm or less. The same differences in hue can be observed when overlapping grains have a combined thickness in the indicated range. Tabular grain emulsions with low tabular grain thickness dispersities can be qualitatively distinguished by the proportions of tabular grains with visually similar hues. Rigorous quantitative determinations of tabular grain thickness dispersities determined from reflected hues have not yet been reported.

Although there has been general photographic interest in reducing the dispersity of the grains in tabular grain emulsions, in dye image reversal photographic elements Sowinski et al U.S. Pat. No. 4,656,122 has reported increased threshold imaging speeds, reduced toe region density, increased maximum density and increased contrast to result from blending a smaller grain emulsion with a tabular grain emulsion, thereby increasing the overall dispersity of the resulting emulsion.

CROSS-REFERENCE FILINGS

The following concurrently filed, commonly assigned patent applications are cross-referenced:

Tsaur and Kam-Ng U.S. Ser. No. 700,220, filed May 14, 1991, titled PROCESS OF PREPARING A REDUCED DISPERSITY TABULAR GRAIN EMULSION, now U.S. Pat. No. 5,147,771, discloses a process for the preparation of tabular grain emulsions of reduced dispersity that employs an alkylene oxide block copolymer surfactant that contains two terminal lipophilic block units joined by a central hydrophilic block unit.

Tsaur and Kam-Ng U.S. Ser. No. 700,019, filed May 14, 1991, titled PROCESS OF PREPARING A REDUCED DISPERSITY TABULAR GRAIN EMULSION, now U.S. Pat. No. 5,147,773, discloses a process for the preparation of tabular grain emulsions of reduced dispersity that employs an alkylene oxide block copolymer surfactant that contains two terminal hydrophilic block units joined by a central lipophilic block unit.

Tsaur and Kam-Ng U.S. Ser. No. 699,851, filed May 14, 1991, titled PROCESS OF PREPARING A REDUCED DISPERSITY TABULAR GRAIN EMULSION, now U.S. Pat. No. 5,147,773, discloses a process for the preparation of tabular grain emulsions of reduced dispersity that employs an alkylene oxide block copolymer surfactant that contains at least three terminal hydrophilic block units joined by a central lipophilic block linking unit.

Tsaur and Kam-Ng U.S. Ser. No. 700,020, filed May 14, 1991, titled PROCESS OF PREPARING A REDUCED DISPERSITY TABULAR GRAIN EMULSION, now U.S. Pat. No. 5,147,772 discloses a process for the preparation of tabular grain emulsions of reduced dispersity that employs an alkylene oxide block copolymer surfactant that contains at least three terminal lipophilic block units joined by a central hydrophilic block linking unit.

Tsaur and Kam-Ng U.S. Ser. No. 699,855, filed May 14, 1991, titled A VERY LOW COEFFICIENT OF VARIATION TABULAR GRAIN EMULSION discloses a coprecipitated grain population having a coefficient of variation of less than 10 percent and consisting essentially of tabular grains.

Dickerson and Tsaur U.S. Ser. No. 699,840, filed May 14, 1991, titled RADIOGRAPHIC ELEMENTS WITH IMPROVED DETECTIVE QUANTUM EFFICIENCIES now abandoned in favor of U.S. Ser. No. 849,917, filed Mar. 12, 1992, discloses a dual coated radiographic element containing a tabular grain emulsion having a coefficient of variation of less than 15 percent.

SUMMARY OF THE INVENTION

In one aspect, this invention is directed to multicolor photographic element capable of forming a viewable reversal dye image comprising a support and, coated on the support, a blue recording yellow dye image forming layer unit, a green recording magenta dye image forming layer unit, and a red recording cyan dye image forming layer unit, each of the layer units containing in at least one layer a silver halide emulsion having a grain halide content of from 0 to 5 mole percent chloride, from 0.1 to 20 mole percent iodide, and from 80 to 99.9 mole percent bromide, based on total silver.

The photographic element is characterized in that at least one of the silver halide emulsion layers is a tabular grain emulsion layer in which the coefficient of variation of the tabular grain emulsion is less than 15 percent, based on the total grain population of the emulsion, and the total grain population of the tabular emulsion consists essentially of tabular grains having a mean thickness of less than 0.3 μm and a mean tabularity of greater than 25.

It has been discovered that, when a multicolor photographic element capable of forming a viewable reversal dye image is constructed with at least one high tabularity tabular grain emulsion layer using a tabular grain emulsion substantially free of nontabular grains and having high (>25) tabularity and highly monodisperse (COV<15%) tabular grains, a variety of advantages can be realized as compared to conventional dye image reversal photographic elements containing tabular grain emulsions. Among the most important advantages are enhancement of image sharpness and contrast. Image sharpness is increased not only in the emulsion layer or layers containing the tabular grain emulsion, but in underlying emulsion layers as well. The increases in contrast observed are particularly important because the iodide and/or development inhibitors incorporated in dye image reversal photographic elements to achieve useful interimage effects have the effect of reducing contrast. By employing a tabular grain emulsion satisfying the requirements of this invention it is possible to offset contrast loss attributable to the presence of iodide and/or development inhibitors. Improvements in speed and reductions in granularity can also be achieved by employing tabular grain emulsions of reduced dispersity.

In providing tabular grain emulsions capable of providing the above advantages a first objective is to eliminate or reduce to negligible levels nonconforming grain populations from the tabular grain emulsion during grain precipitation process. The presence of one or more nonconforming grain populations (usually nontabular grains) within an emulsion containing predominantly tabular grains is a primary concern in seeking emulsions of minimal grain dispersity. Nonconforming grain populations in tabular grain emulsions typically exhibit lower projected areas and greater thicknesses than the tabular grains. Nontabular grains interact differently with light on exposure than tabular grains. Whereas the majority of tabular grain surface areas are oriented parallel to the coating plane, nontabular grains exhibit near random crystal facet orientations. The ratio of surface area to grain volume is much higher for tabular grains than for nontabular grains. Finally, lacking parallel twin planes, nontabular grains differ internally from the conforming tabular grains. All of these differences of nontabular grains apply also to nonconforming thick (singly twinned) tabular grains as well.

A second objective is to minimize the ECD variance among conforming tabular grains. Once the nonconforming grain population of a tabular grain emulsion has been well controlled, the next level of concern is the diameter variances among the tabular grains. The probability of photon capture by a particular grain on exposure of an emulsion is a function of its ECD. Spectrally sensitized tabular grains with the same ECDs have the same photon capture capability.

A third objective is to minimize variances in the thicknesses of the tabular grains within the conforming tabular grain population. Achievement of the first two objectives in dispersity control can be measured in terms of COV, which provides a workable criterion for distinguishing emulsions on the basis of grain dispersity. As between tabular grain emulsions of similar COVs further ranking of dispersity can be based on assessments of grain thickness dispersity. At present, this cannot be achieved with the same quantitative precision as in calculating COVs, but it is nevertheless an important basis for distinguishing tabular grain populations. A tabular grain with an ECD of 1.0 μm and a thickness of 0.01 μm contains only half the silver of a tabular grain with the same ECD and a thickness of 0.02 μm. The photon capture capability in the spectral region of native sensitivity of the second grain is twice that of the first, since photon capture within the grain is a function of grain volume. Further, the light reflectances of the two grains are quite dissimilar.

While all of the above advantages can be realized in each of the blue recording yellow dye image forming layer unit, the green recording magenta dye image forming layer unit, and the red recording cyan dye image forming layer unit, the invention is particularly advantageous when low dispersity tabular grain emulsions satisfying the requirements of the invention are incorporated in at least one emulsion layer of the blue recording yellow dye image forming layer unit. One advantage of incorporating the low dispersity tabular grain emulsions of the invention into the blue recording yellow dye image forming layer unit is that this layer unit is usually located nearest the source of exposing radiation (that is, it is coated over the remaining layer units). By reducing unwanted light scattering and reflection in this emulsion layer the imaging performance of each of the underlying emulsion layer units is improved.

DESCRIPTION OF PREFERRED EMBODIMENTS

The invention relates to an improvement in silver halide photographic elements useful in reversal dye imaging. The reversal photographic elements are comprised of a support and one or more blue recording yellow dye image forming layer units, one or more green recording magenta dye image forming layer units, and one or more red recording cyan dye image forming layer units. Any conventional arrangement of layer units can be employed, including particularly any of those set forth by Kofron et al U.S. Pat. No. 4,439,520.

Each of the emulsion layer units contains at least one silver halide emulsion layer. It is common practice to construct an emulsion layer unit of a faster emulsion layer coated over a slower emulsion layer, and in many instances three emulsion layers are present within a single emulsion layer unit. Each of the layer units contain in at least one layer and, preferably, each of its layers, a silver halide emulsion having a grain halide content of from 0 to 5 mole percent chloride, from 0.1 to 20 mole percent iodide, and from 80 to 99.9 mole percent bromide, based on total silver. Iodide is essential to achieving high levels of sensitivity and advantageous interimage effects. Preferred levels of iodide typically range from about 1 to 15 mole percent and are optimally less than 10 mole percent, based on total silver. Low levels of chloride can be tolerated within the grains. The chloride ion here referred to is that which forms a solid solution with the silver bromide in the crystal structure and does not include epitaxial silver chloride, which is viewed as a grain sensitizer, rather than as a part of the grain structure. Conventionally silver bromoiodide emulsions have been most extensively employed in reversal imaging, and these are particularly contemplated for use in the practice of the invention.

At least one of the emulsions in at least one of the dye image forming layer units is a high tabularity ($D/t^2>25$), low dispersity ($COV<15\%$) tabular grain emulsion and optimally a minimum dispersity ($COV<10\%$) emulsion. While a single high tabularity, low dispersity tabular grain emulsion provides one or more of the imaging advantages noted above when located in any layer of any one of the dye image forming layer units, when a single high tabularity, low dispersity tabular grain emulsion layer is present, it is preferred that it be located in the dye image forming layer unit which first receives exposing radiation (that is, the layer unit farthest from the support). In this location the emulsion contributes to increasing the image sharpness of each of the layer units of the reversal photographic element. In the most common arrangement of layer units, this places the high tabularity, low dispersity tabular grain emulsion layer in the blue recording dye image forming layer unit. It is contemplated to place the high tabularity, low dispersity emulsions in each of the dye image forming layer units. Within the dye image forming layer units the high tabularity, low dispersity emulsions can constitute each and every emulsion layer. When less than all of the emulsion layers are high tabularity, low dispersity emulsion layers, it is most advantageous to locate the high tabularity, low dispersity emulsion in the fastest of the emulsion layers. This is typically located within the layer unit so that it is nearest the source of exposing radiation and farthest from the support. When this arrangement is chosen, the high tabularity, low dispersity emulsion layer will improve the imaging qualities not only of the emulsion layer it constitutes, but also the imaging qualities of each underlying emulsion layer.

The reversal dye image forming photographic elements of this invention have been realized by the discovery and optimization of novel processes for the precipitation of high tabularity, low dispersity tabular grain emulsions. Grain populations consisting essentially of tabular grains having mean thicknesses in the range of from 0.080 to 0.3 μm and mean tabularities (as defined above) of greater than 25 are well within the capabilities of the precipitation procedures set forth below. These ranges permit any mean tabular grain ECD to be selected appropriate for the photographic application. In other words, the present invention is compatible with the full range of mean ECDs of conventional tabular grain emulsions. A mean ECD of about 10 μm is typically regarded as the upper limit for photographic utility. For most applications the tabular grains exhibit a mean ECD of 5 μm or less. Since increased ECDs contribute to achieving higher mean aspect ratios and tabularities, it is generally preferred that mean ECDs of the tabular grains be at least about 0.4 μm. When the high tabularity, low dispersity emulsions are present in the blue recording layer unit, the tabular grains as well as any spectral sensitizing dye, if present, can be relied upon to absorb blue light. In the blue recording layer unit tabular grain thicknesses of up to 0.3 μm or even higher can be employed, although it is usually preferred to limit mean tabular grain thicknesses to less than 0.2 μm to increase mean tabularities and to increase the specular transmittance of green and red light. In the green and red recording layer units almost all absorbed green or red light is absorbed by spectral sensitizing dye rather than by the tabular grains, and it is therefore preferred that the tabular grains exhibit a thickness of less than 0.2 μm, with even thinner tabular grains—e.g. less than 0.1 μm being contemplated.

Any mean tabular grain aspect ratio within the mean tabular grain thickness and tabularity ranges indicated is contemplated. Mean tabular grain aspect ratios for the tabular grains preferably range from 3 to 100 or more. For the majority of photographic applications mean tabular grain aspect ratios in the range of from about 5 to 50 are most practical.

While mean aspect ratios have been most extensively used in the art to characterize dimensionally tabular grain emulsions, mean tabularities ($D/t^2$, as defined) provide an even better quantitative measure of the qualities that set tabular grain populations apart from nontabular grain populations. The emulsions of the invention contain exhibit tabularities of greater than 25. Typically mean tabularities of the tabular grain emulsions range up to about 500. Since tabularities are increased exponentially with decreased tabular grain mean thicknesses, extremely high tabularities can be realized ranging up to 1000 or more.

The high tabularity, low dispersity emulsions employed in the reversal photographic elements of this invention differ from conventional emulsions in every instance in two respects:

(1) First, the emulsions consist essentially of tabular grains. That is, substantially the entire grain projected area of the emulsions is accounted for by tabular grains. As more fully explained below, in quantitative terms, this means that greater than 97 percent (optimally greater than 98 percent) of the total projected area of grains having an effective circular diameter large enough to scatter light significantly is accounted for by the tabular grains.

(2) Second, the emulsions exhibit a COV of less than 15 percent and optimally less than 10 percent, based on the entire grain population present in the emulsion. Failing to achieve (1) above, the art has been able to generate low COV numbers only by excluding nontabular grains. Such COV's are, of course, not comparable to those that are based on a total grain population.

In addition to exhibiting minimum COVs the emulsions employed in the practice of this invention also exhibit low grain-to-grain variations in the thicknesses of the coprecipitated tabular grain population. This has been observed by the low chromatic variances of light reflections from the tabular grain population. Tabular grain emulsions have been prepared in which the majority of the tabular grains are of one hue or closely related family of hues. Tabular grain emulsions satisfying the requirements of this invention have been prepared in which the majority of the tabular grains are either white, yellow, buff, brown, purple, blue, cyan, green, orange, magenta or red. From these observations it has been determined that the minimum COV emulsions of this invention can be prepared with greater than 50 percent, preferably greater than 70 percent and optimally greater than 90 percent of the total tabular grain projected area exhibiting a hue indicative of thickness variations within ±0.01 μm of the mean tabular grain thickness.

By having tabular grain populations of more uniform thickness it is possible to achieve more efficient multicolor imaging. For example, the tabular grains of the blue recording emulsion layer unit can be selected to have a thickness which preferentially absorbs blue light and exhibits a high level of transmission of green and red light to underlying layers. Since there is more grain-to-grain uniformity in the tabular grains, less of the green and red light is reflected in the blue recording layer unit by tabular grains of anomalous thicknesses. Similarly, an underlying green recording layer unit can contain tabular grains which more uniformly transmit red light to an underlying red recording emulsion layer unit or reflect blue light back to the overlying blue recording layer unit. Even the layer unit nearest the support, usually the red recording layer unit, can benefit imaging properties by containing a tabular grain population of more uniform thickness. The red recording layer unit can have the tabular grain thicknesses chosen to reflect more uniformly either blue or green light. Although novel structural features (1) and (2) above are capable of providing significant photographic advantages of the type indicated above in the absence of reduced grain-to-grain thickness variations, in practice the high tabularity, low dispersity tabular grain emulsions usually contain all three of the discussed structural advantages.

The emulsions contemplated for use have been made available by the discovery and optimization of improved processes for the preparation of tabular grain emulsions by (a) first forming a population of grain nuclei, (b) ripening out a portion of the grain nuclei in the presence of a ripening agent, and (c) undertaking post-ripening grain growth. Coprecipitated grain population emulsions consisting essentially of tabular grains satisfying the requirements of this invention has resulted from the discovery of specific techniques for forming the population of grain nuclei.

To achieve the lowest possible grain dispersities the first step is to undertake formation of the silver halide grain nuclei under conditions that promote uniformity. Prior to forming the grain nuclei bromide ion is added to the dispersing medium. Although other halides can be added to the dispersing medium along with silver, prior to introducing silver, halide ions in the dispersing medium consist essentially of bromide ions.

The balanced double jet precipitation of grain nuclei is specifically contemplated in which an aqueous silver salt solution and an aqueous bromide salt are concurrently introduced into a dispersing medium containing water and a hydrophilic colloid peptizer. One or both of chloride and iodide salts can be introduced through the bromide jet or as a separate aqueous solution through a separate jet. It is preferred to limit the concentration of chloride and/or iodide to the overall levels described above or less during grain nucleation. Silver nitrate is the most commonly utilized silver salt while the halide salts most commonly employed are ammonium halides and alkali metal (e.g., lithium, sodium or potassium) halides. The ammonium counter ion does not function as a ripening agent since the dispersing medium is at an acid pH—i.e., less than 7.0.

Instead of introducing aqueous silver and halide salts through separate jets a uniform nucleation can be achieved by introducing a Lippmann emulsion into the dispersing medium. Since the Lippmann emulsion grains typically have a mean ECD of less than 0.05 μm, a small fraction of the Lippmann grains initially introduced serve as deposition sites while all of the remaining Lippmann grains dissociate into silver and halide ions that precipitate onto grain nuclei surfaces. Techniques for using small, preformed silver halide grains as a feedstock for emulsion precipitation are illustrated by Mignot U.S. Pat. No. 4,334,012; Saito U.S. Pat. No. 4,301,241; and Solberg et al U.S. Pat. No. 4,433,048.

The low COV emulsions contemplated for use can be prepared by producing prior to ripening a population of parallel twin plane containing grain nuclei in the presence of selected surfactants. Specifically, it has been discovered that the dispersity of the tabular grain emulsions of this invention can be reduced by introducing parallel twin planes in the grain nuclei in the presence of one or a combination of polyalkylene oxide block copolymer surfactants. Polyalkylene oxide block copolymer surfactants generally and those contemplated for use in preparing the emulsions of this invention in particular are well known and have been widely used for a variety of purposes. They are generally recognized to constitute a major category of nonionic surfactants. For a molecule to function as a surfactant it must contain at least one hydrophilic unit and at least one lipophilic unit linked together. A general review of block copolymer surfactants is provided by I. R. Schmolka, "A Review of Block Polymer Surfactants", J. Am. Oil Chem. Soc., Vol. 54, No. 3, 1977, pp. 110–116, and A. S. Davidsohn and B. Milwidsky, *Synthetic Detergents*, John Wiley & Sons, N.Y. 1987, pp. 29–40, and particularly pp. 34–36, the disclosures of which are here incorporated by reference.

One category of polyalkylene oxide block copolymer surfactant found to be useful in the preparation of the emulsions is comprised of two terminal lipophilic alkylene oxide block units linked by a hydrophilic alkylene oxide block unit accounting for at least 4 percent of the molecular weight of the copolymer. These surfactants are hereinafter referred to category S-I surfactants.

The category S-I surfactants contain at least two terminal lipophilic alkylene oxide block units linked by a hydrophilic alkylene oxide block unit and can be, in a simple form, schematically represented as indicated by diagram I below:

| | | |
|---|---|---|
| LAO1 | HAO1 | LAO1 |

(I)

where

LAO1 in each occurrence represents a terminal lipophilic alkylene oxide block unit and HAO1 represents a linking hydrophilic alkylene oxide block unit.

It is generally preferred that HAO1 be chosen so that the hydrophilic block unit constitutes from 4 to 96 percent of the block copolymer on a total weight basis.

It is, of course, recognized that the block diagram I above is only one example of a polyalkylene oxide block copolymer having at least two terminal lipophilic block units linked by a hydrophilic block unit. In a common variant structure interposing a trivalent amine linking group in the polyalkylene oxide chain at one or both of the interfaces of the LAO1 and HAO1 block units can result in three or four terminal lipophilic groups.

In their simplest possible form the category S-I polyalkylene oxide block copolymer surfactants are formed by first condensing ethylene glycol and ethylene oxide to form an oligomeric or polymeric block repeating unit that serves as the hydrophilic block unit and then completing the reaction using 1,2-propylene oxide. The propylene oxide adds to each end of the ethylene oxide block unit. At least six 1,2-propylene oxide repeating units are required to produce a lipophilic block repeating unit. The resulting polyalkylene oxide block copolymer surfactant can be represented by formula II:

$$HO-(\overset{CH_3}{\overset{|}{C}}HCH_2O)_x-(CH_2CH_2O)_y-(CH_2\overset{CH_3}{\overset{|}{C}}HO)_{x'}-H \quad \text{(II)}$$

where x and x' are each at least 6 and can range up to 120 or more and y is chosen so that the ethylene oxide block unit maintains the necessary balance of lipophilic and hydrophilic qualities necessary to retain surfactant activity.

It is generally preferred that y be chosen so that the hydrophilic block unit constitutes from 4 to 96 percent by weight of the total block copolymer. Within the above ranges for x and x', y can range from 2 to 300 or more.

Generally any category S-I surfactant block copolymer that retains the dispersion characteristics of a surfactant can be employed. It has been observed that the surfactants are fully effective either dissolved or physically dispersed in the reaction vessel. The dispersal of the polyalkylene oxide block copolymers is promoted by the vigorous stirring typically employed during the preparation of tabular grain emulsions. In general surfactants having molecular weights of less than about 16,000, preferably less than about 10,000, are contemplated for use.

In a second category, hereinafter referred to as category S-II surfactants, the polyalkylene oxide block copolymer surfactants contain two terminal hydrophilic alkylene oxide block units linked by a lipophilic alkylene oxide block unit and can be, in a simple form, schematically represented as indicated by diagram III below:

| | | |
|---|---|---|
| HAO2 | LAO2 | HAO2 |

(III)

where

HAO2 in each occurrence represents a terminal hydrophilic alkylene oxide block unit and LAO2 represents a linking lipophilic alkylene oxide block unit.

It is generally preferred that LAO2 be chosen so that the lipophilic block unit constitutes from 4 to 96 percent of the block copolymer on a total weight basis.

It is, of course, recognized that the block diagram III above is only one example of a category S-II polyalkylene oxide block copolymer having at least two terminal hydrophilic block units linked by a lipophilic block unit. In a common variant structure interposing a trivalent amine linking group in the polyakylene oxide chain at one or both of the interfaces of the LAO2 and HAO2 block units can result in three or four terminal hydrophilic groups.

In their simplest possible form the category S-II polyalkylene oxide block copolymer surfactants are formed by first condensing 1,2-propylene glycol and 1,2-propylene oxide to form an oligomeric or polymeric block repeating unit that serves as the lipophilic block unit and then completing the reaction using ethylene oxide. Ethylene oxide is added to each end of the 1,2-propylene oxide block unit. At least thirteen (13) 1,2-propylene oxide repeating units are required to produce a lipophilic block repeating unit. The resulting polyalkylene oxide block copolymer surfactant can be represented by formula IV:

$$HO-(CH_2CH_2O)_y-(\overset{CH_3}{\overset{|}{C}}HCH_2O)_x-(CH_2CH_2O)_{y'}-H \quad (IV)$$

where x is at least 13 and can range up to 490 or more and y and y' are chosen so that the ethylene oxide block units maintain the necessary balance of lipophilic and hydrophilic qualities necessary to retain surfactant activity.

It is generally preferred that x be chosen so that the lipophilic block unit constitutes from 4 to 96 percent by weight of the total block copolymer; thus, within the above range for x, y and y' can range from 1 to 320 or more.

Any category S-II block copolymer surfactant that retains the dispersion characteristics of a surfactant can be employed. It has been observed that the surfactants are fully effective either dissolved or physically dispersed in the reaction vessel. The dispersal of the polyalkylene oxide block copolymers is promoted by the vigorous stirring typically employed during the preparation of tabular grain emulsions. In general surfactants having molecular weights of less than about 30,000, preferably less than about 20,000, are contemplated for use.

In a third category, hereinafter referred to as category S-III surfactants, the polyalkylene oxide surfactants contain at least three terminal hydrophilic alkylene oxide block units linked through a lipophilic alkylene oxide block linking unit and can be, in a simple form, schematically represented as indicated by formula V below:

$$(H-HAO3)_z-LOL-(HAO3-H)_{z'} \quad (V)$$

where

HAO3 in each occurrence represents a terminal hydrophilic alkylene oxide block unit, LOL represents a lipophilic alkylene oxide block linking unit, z is 2 and z' is 1 or 2.

The polyalkylene oxide block copolymer surfactants employed can take the form shown in formula VI:

$$(H-HAO3-LAO3)_z-L-(LAO3-HAO3-H)_{z'} \quad (VI)$$

where

HAO3 in each occurrence represents a terminal hydrophilic alkylene oxide block unit, LAO3 in each occurrence represents a lipophilic alkylene oxide block unit, L represents a linking group, such as amine or diamine, z is 2 and z' is 1 or 2.

The linking group L can take any convenient form. It is generally preferred to choose a linking group that is itself lipophilic. When z+z' equal three, the linking group must be trivalent. Amines can be used as trivalent linking groups. When an amine is used to form the linking unit L, the polyalkylene oxide block copolymer surfactants employed can take the form shown in formula VII:

$$\begin{array}{ccc} & (R^1)_a-LAO3-HAO3-H & \\ & | & \\ & N & \\ H-HAO3-LAO3-(R^2)_b & & (R^3)_c-LAO3-HAO3-H \end{array} \quad (VII)$$

where

HAO3 and LAO3 are as previously defined;

$R^1$, $R^2$ and $R^3$ are independently selected hydrocarbon linking groups, preferably phenylene groups or alkylene groups containing from 1 to 10 carbon atoms; and a, b and c are independently zero or 1.

To avoid steric hindrances it is generally preferred that at least one (optimally at least two) of a, b and c be 1. An amine (preferably a secondary or tertiary amine) having hydroxy functional groups for entering into an oxyalkylation reaction is a contemplated starting material for forming a polyalkylene oxide block copolymer satisfying formula VII.

When z+z' equal four, the linking group must be tetravalent. Diamines are preferred tetravalent linking groups. When a diamine is used to form the linking unit L, the polyalkylene oxide block copolymer surfactants employed can take the form shown in the formula VIII:

$$\begin{array}{ccc} H-HAO3-LAO3-(R^5)_e & & (R^8)_g-LAO3-HAO3-H \\ & N-R^6-N & \\ H-HAO3-LAO3-(R^4)_d & & (R^7)_f-LAO3-HAO3-H \end{array} \quad (VIII)$$

where

HAO3 and LAO3 are as previously defined;

$R^4$, $R^5$, $R^6$, $R^7$ and $R^8$ are independently selected hydrocarbon linking groups, preferably phenylene groups or alkylene groups containing from 1 to 10 carbon atoms; and d, e, f and g are independently zero or 1.

It is generally preferred that LAO3 be chosen so that the LOL lipophilic block unit accounts for from 4 to less than 96 percent, preferably from 15 to 95 percent, optimally 20 to 90 percent, of the molecular weight of the copolymer.

In a fourth category, hereinafter referred to as category S-IV surfactants, the polyalkylene oxide block copolymer surfactants employed contain at least three terminal lipophilic alkylene oxide block units linked through a hydrophilic alkylene oxide block linking unit and can be, in a simple form, schematically represented as indicated by formula IX below:

$$(H-LAO4)_z-HOL-(LAO4-H)_{z'} \quad (IX)$$

where

LAO4 in each occurrence represents a terminal lipophilic alkylene oxide block unit, HOL represents a hydrophilic alkylene oxide block linking unit, z is 2 and z' is 1 or 2.

The polyalkylene oxide block copolymer surfactants employed can take the form shown in formula X:

$$(H-LAO4-HAO4)_z-L'-(HAO4-LAO4-H)_{z'} \quad (X)$$

where

HAO4 in each occurrence represents a hydrophilic alkylene oxide block unit.

LAO4 in each occurrence represents a terminal lipophilic alkylene oxide block unit, L' represents a linking group, such as amine or diamine, z is 2 and z' is 1 or 2.

The linking group L' can take any convenient form. It is generally preferred to choose a linking group that is itself hydrophilic. When z+z' equal three, the linking group must be trivalent. Amines can be used as trivalent linking groups. When an amine is used to form the linking unit L', the polyalkylene oxide block copolymer surfactants employed can take the form shown in formula XI:

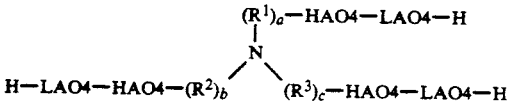

(XI)

where

HAO4 and LAO4 are as previously defined;

$R^1$, $R^2$ and $R^3$ are independently selected hydrocarbon linking groups, preferably phenylene groups or alkylene groups containing from 1 to 10 carbon atoms; and a, b and c are independently zero or 1.

To avoid steric hindrances it is generally preferred that at least one (optimally at least two) of a, b and c be 1. An amine (preferably a secondary or tertiary amine) having hydroxy functional groups for entering into an oxyalkylation reaction is a contemplated starting material for forming a polyalkylene oxide block copolymer satisfying formula XI.

When z+z' equal four, the linking group must be tetravalent. Diamines are preferred tetravalent linking groups. When a diamine is used to form the linking unit L', the polyalkylene oxide block copolymer surfactants employed can take the form shown in formula XII:

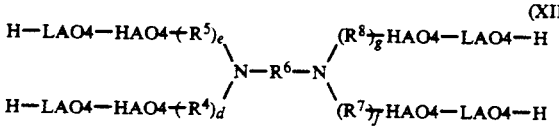

(XII)

where

HAO4 and LAO4 are as previously defined;

$R^4$, $R^5$, $R^6$, $R^7$ and $R^8$ are independently selected hydrocarbon linking groups, preferably phenylene groups or alkylene groups containing from 1 to 10 carbon atoms; and d, e, f and g are independently zero or 1.

It is generally preferred that LAO4 be chosen so that the HOL hydrophilic block unit accounts for from 4 to 96 percent, preferably from 5 to 85 percent, of the molecular weight of the copolymer.

In their simplest possible form the polyalkylene oxide block copolymer surfactants of categories S-III and S-IV employ ethylene oxide repeating units to form the hydrophilic (HAO3 and HAO4) block units and 1,2-propylene oxide repeating units to form the lipophilic (LAO3 and LAO4) block units. At least three propylene oxide repeating units are required to produce a lipophilic block repeating unit. When so formed, each H-HAO3-LAO3- or H-LAO4-HAO4- group satisfies formula XIIIa or XIIIb, respectively:

$$H-(OCH_2CH_2)_y-(O\overset{CH_3}{\overset{|}{C}}HCH_2)_x- \quad (XIIIa)$$

$$H-(O\overset{CH_3}{\overset{|}{C}}HCH_2)_x-(OCH_2CH_2)_y- \quad (XIIIb)$$

where x is at least 3 and can range up to 250 or more and y is chosen so that the ethylene oxide block unit maintains the necessary balance of lipophilic and hydrophilic qualities necessary to retain surfactant activity.

This allows y to be chosen so that the hydrophilic block units together constitute from greater than 4 to 96 percent (optimally 10 to 80 percent) by weight of the total block copolymer. In this instance the lipophilic alkylene oxide block linking unit, which includes the 1,2-propylene oxide repeating units and the linking moieties, constitutes from 4 to 96 percent (optimally 20 to 90 percent) of the total weight of the block copolymer. Within the above ranges, y can range from 1 (preferably 2) to 340 or more.

The overall molecular weight of the polyalkylene oxide block copolymer surfactants of categories S-III and S-IV have a molecular weight of greater than 1100, preferably at least 2,000. Generally any such block copolymer that retains the dispersion characteristics of a surfactant can be employed. It has been observed that the surfactants are fully effective either dissolved or physically dispersed in the reaction vessel. The dispersal of the polyalkylene oxide block copolymers is promoted by the vigorous stirring typically employed during the preparation of tabular grain emulsions. In general category S-III surfactants having molecular weights of less than about 60,000, preferably less than about 40,000, are contemplated for use, category S-IV surfactants having molecular weight of less than 50,000, preferably less than about 30,000, are contemplated for use.

While commercial surfactant manufacturers have in the overwhelming majority of products selected 1,2-propylene oxide and ethylene oxide repeating units for forming lipophilic and hydrophilic block units of nonionic block copolymer surfactants on a cost basis, it is recognized that other alkylene oxide repeating units can, if desired, be substituted in any of the category S-I, S-II, S-III and S-IV surfactants, provided the intended lipophilic and hydrophilic properties are retained. For example, the propylene oxide repeating unit is only one of a family of repeating units that can be illustrated by formula XIV $$-(OCH\overset{R^9}{\overset{|}{C}}H_2)- \qquad \text{(XIV)}$$

where $R^9$ is a lipophilic group, such as a hydrocarbon—e.g., alkyl of from 1 to 10 carbon atoms or aryl of from 6 to 10 carbon atoms, such as phenyl or naphthyl.

In the same manner, the ethylene oxide repeating unit is only one of a family of repeating units that can be illustrated by formula XV:

$$-(OCH\overset{R^{10}}{\overset{|}{C}}H_2)- \qquad \text{(XV)}$$

where $R^{10}$ is hydrogen or a hydrophilic group, such as a hydrocarbon group of the type forming $R^9$ above additionally having one or more polar substituents—e.g., one, two, three or more hydroxy and/or carboxy groups.

In each of the surfactant categories each of block units contain a single alkylene oxide repeating unit selected to impart the desired hydrophilic or lipophilic quality to the block unit in which it is contained. Hydrophilic-lipophilic balances (HLB's) of commercially available surfactants are generally available and can be consulted in selecting suitable surfactants.

Only very low levels of surfactant are required in the emulsion at the time parallel twin planes are being introduced in the grain nuclei to reduce the grain dispersity of the emulsion being formed. Surfactant weight concentrations are contemplated as low as 0.1 percent, based on the interim weight of silver—that is, the weight of silver present in the emulsion while twin planes are being introduced in the grain nuclei. A preferred minimum surfactant concentration is 1 percent, based on the interim weight of silver. A broad range of surfactant concentrations have been observed to be effective. No further advantage has been realized for increasing surfactant weight concentrations above 100 percent of the interim weight of silver using category S-I surfactants or above 50 percent of the interim weight of silver using category S-II, S-III or S-IV surfactants. However, surfactant concentrations of 200 percent of the interim weight of silver or more are considered feasible using category S-I surfactants or 100 percent or more using category S-II, S-III or S-IV surfactants.

The preparation process is compatible with either of the two most common techniques for introducing parallel twin planes into grain nuclei. The preferred and most common of these techniques is to form the grain nuclei population that will be ultimately grown into tabular grains while concurrently introducing parallel twin planes in the same precipitation step. In other words, grain nucleation occurs under conditions that are conducive to twinning. The second approach is to form a stable grain nuclei population and then adjust the pAg of the interim emulsion to a level conducive to twinning.

Regardless of which approach is employed, it is advantageous to introduce the twin planes in the grain nuclei at an early stage of precipitation. It is contemplated to obtain a grain nuclei population containing parallel twin planes using less than 2 percent of the total silver used to form the tabular grain emulsion. It is usually convenient to use at least 0.05 percent of the total silver to form the parallel twin plane containing grain nuclei population, although this can be accomplished using even less of the total silver. The longer introduction of parallel twin planes is delayed after forming a stable grain nuclei population the greater is the tendency toward increased grain dispersity.

At the stage of introducing parallel twin planes in the grain nuclei, either during initial formation of the grain nuclei or immediately thereafter, the lowest attainable levels of grain dispersity in the completed emulsion are achieved by control of the dispersing medium.

The pAg of the dispersing medium is preferably maintained in the range of from 5.4 to 10.3 and, for achieving a COV of less than 10 percent, optimally in the range of from 7.0 to 10.0. At a pAg of greater than 10.3 a tendency toward increased tabular grain ECD and thickness dispersities is observed. Any convenient conventional technique for monitoring and regulating pAg can be employed.

Reductions in grain dispersities have also been observed as a function of the pH of the dispersing medium. Both the incidence of nontabular grains and the thickness dispersities of the nontabular grain population have been observed to decrease when the pH of the dispersing medium is less than 6.0 at the time parallel twin planes are being introduced into the grain nuclei. The pH of the dispersing medium can be regulated in any convenient conventional manner. A strong mineral acid, such as nitric acid, can be used for this purpose.

Grain nucleation and growth occurs in a dispersing medium comprised of water, dissolved salts and a conventional peptizer. Hydrophilic colloid peptizers such as gelatin and gelatin derivatives are specifically contemplated. Peptizer concentrations of from 20 to 800 (optimally 40 to 600) grams per mole of silver introduced during the nucleation step have been observed to produce emulsions of the lowest grain dispersity levels.

The formation of grain nuclei containing parallel twin planes is undertaken at conventional precipitation temperatures for photographic emulsions, with temperatures in the range of from 20° to 80° C. being particularly preferred and temperature of from 20° to 60° C. being optimum.

Once a population of grain nuclei containing parallel twin planes has been established as described above, the next step is to reduce the dispersity of the grain nuclei population by ripening. The objective of ripening grain nuclei containing parallel twin planes to reduce dispersity is disclosed by both Himmelwright U.S. Pat. No. 4,477,565 and Nottorf U.S. Pat. No. 4,722,886, the disclosures of which are here incorporated by reference. Ammonia and thioethers in concentrations of from about 0.01 to 0.1N constitute preferred ripening agent selections.

Instead of introducing a silver halide solvent to induce ripening it is possible to accomplish the ripening step by adjusting pH to a high level—e.g., greater than 9.0. A ripening process of this type is disclosed by Buntaine and Brady U.S. Pat. No. 5,013,641, issued May 7, 1991. In this process the post nucleation ripening step is performed by adjusting the pH of the dispersing medium to greater than 9.0 by the use of a base, such as an alkali hydroxide (e.g., lithium, sodium or potassium hydroxide) followed by digestion for a short period (typically 3 to 7 minutes). At the end of the ripening step the emulsion is again returned to the acidic pH ranges conventionally chosen for silver halide precipitation (e.g. less than 6.0) by introducing a conventional acidifying agent, such as a a mineral acid (e.g., nitric acid).

Some reduction in dispersity will occur no matter how abbreviated the period of ripening. It is preferred to continue ripening until at least about 20 percent of the total silver has been solubilized and redeposited on the remaining grain nuclei. The longer ripening is extended the fewer will be the number of surviving nuclei. This means that progressively less additional silver halide precipitation is required to produce tabular grains of an aim ECD in a subsequent growth step. Looked at another way, extending ripening decreases the size of the emulsion make in terms of total grams of silver precipitated. Optimum ripening will vary as a function of aim emulsion requirements and can be adjusted as desired.

Once nucleation and ripening have been completed, further growth of the emulsions can be undertaken in any conventional manner consistent with achieving desired final mean grain thicknesses and ECDs. The halides introduced during grain growth can be selected independently of the halide selections for nucleation. The tabular grain emulsion can contain grains of either uniform or nonuniform silver halide composition.

In optimizing the process of preparation for minimum tabular grain dispersity levels it has been observed that optimizations differ as a function of iodide incorporation in the grains as well as the choices of surfactants and/or peptizers.

While any conventional hydrophilic colloid peptizer can be employed, it is preferred to employ gelatino-peptizers during precipitation. Gelatino-peptizers are commonly divided into so-called "regular" gelatino-peptizers and so-called "oxidized" gelatino-peptizers. Regular gelatino-peptizers are those that contain naturally occurring amounts of methionine of at least 30 micromoles of methionine per gram and usually considerably higher concentrations. The term oxidized gelatino-peptizer refers to gelatino-peptizers that contain less than 30 micromoles of methionine per gram. A regular gelatino-peptizer is converted to an oxidized gelatino-peptizer when treated with a strong oxidizing agent, such as taught by Maskasky U.S. Pat. No. 4,713,323 and King et al U.S. Pat. No. 4,942,120, the disclosures of which are here incorporated by reference. The oxidizing agent attacks the divalent sulfur atom of the methionine moiety, converting it to a tetravalent or, preferably, hexavalent form. While methionine concentrations of less than 30 micromoles per gram have been found to provide oxidized gelatino-peptizer performance characteristics, it is preferred to reduce methionine concentrations to less than 12 micromoles per gram. Any efficient oxidation will generally reduce methionine to less than detectable levels. Since gelatin in rare instances naturally contains low levels of methionine, it is recognized that the terms "regular" and "oxidized" are used for convenience of expression while the true distinguishing feature is methionine level rather than whether or not an oxidation step has been performed.

When an oxidized gelatino-peptizer is employed, it is preferred to maintain a pH during twin plane formation of less than 5.2 to achieve a minimum (less than 10 percent) COV. When a regular gelatino-peptizer is employed, the pH during twin plane formation is maintained at less than 3.0 to achieve a minimum COV.

When regular gelatin and a category S-I surfactant are each employed prior to post-ripening grain growth, the category S-I surfactant is selected so that the hydrophilic block (e.g., HAO1) accounts for 4 to 96 (preferably 5 to 85 and optimally 10 to 80) percent of the total surfactant molecular weight. It is preferred that x and x' (in formula II) be at least 6 and that the minimum molecular weight of the surfactant be at least 760 and optimally at least 1000, with maximum molecular weights ranging up to 16,000, but preferably being less than 10,000.

When the category S-I surfactant is replaced by a category S-II surfactant, the latter is selected so that the lipophilic block (e.g., LAO2) accounts for 4 to 96 (preferably 15 to 95 and optimally 20 to 90) percent of the total surfactant molecular weight. It is preferred that x (formula IV) be at least 13 and that the minimum molecular weight of the surfactant be at least 800 and optimally at least 1000, with maximum molecular weights ranging up to 30,000, but preferably being less than 20,000.

When a category S-III surfactant is selected for this step, it is selected so that the lipophilic alkylene oxide block linking unit (LOL) accounts for 4 to 96 percent, preferably 15 to 95 percent, and optimally 20 to 90 percent of the total surfactant molecular weight. In the ethylene oxide and 1,2-propylene oxide forms shown in formula (XIIIa), x can range from 3 to 250 and y can range from 2 to 340 and the minimum molecular weight of the surfactant is greater than 1,100 and optimally at least 2,000, with maximum molecular weights ranging up to 60,000, but preferably being less than 40,000. The concentration levels of surfactant are preferably restricted as iodide levels are increased.

When a category S-IV surfactant is selected for this step, it is selected so that the hydrophilic alkalylene oxide block linking unit (HOL) accounts for 4 to 96 percent, preferably 5 to 85 percent, and optimally 10 to 80 percent of the total surfactant molecular weight. In the ethylene oxide and 1,2-propylene oxide forms shown in formula (XIIIb), x can range from 3 to 250 and y can range from 2 to 340 and the minimum molecular weight of surfactant is greater than 1,100 and optimally at least 2,000, with maximum molecular weights ranging up to 50,000, but preferably being less than 30,000.

When oxidized gelatino-peptizer is employed prior to post-ripening grain growth and no iodide is added during post-ripening grain growth, minimum COV emulsions can be prepared with category S-I surfactants chosen so that the hydrophilic block (e.g., HAO1) accounts for 4 to 35 (optimally 10 to 30) percent of the total surfactant molecular weight. The minimum molecular weight of the surfactant continues to be determined by the minimum values of x and x' (formula II) of 6. In optimized forms x and x' (formula II) are at least 7. Minimum COV emulsions can be prepared with category S-II surfactants chosen so that the lipophilic block (e.g., LAO2) accounts for 40 to 96 (optimally 60 to 90) percent of the total surfactant molecular weight. The minimum molecular weight of the surfactant continues to be determined by the minimum value of x (formula IV) of 13. The same molecular weight ranges for both category S-I and S-II surfactants are applicable as in using regular gelatino-peptizer as described above.

The polyalkylene oxide block copolymer surfactant can, if desired, be removed from the emulsion after it has been fully prepared. Any convenient conventional washing procedure, such as those illustrated by *Research Disclosure,* Vol. 308, Dec. 1989, Item 308,119, Section II, can be employed. The polyalkylene oxide block copolymer surfactant constitutes a detectable component of the final emulsion when present in concentrations greater than 0.02 percent, based on the total weight of silver.

Apart from the features described above the reversal dye image forming photographic elements of the invention can be constructed using conventional features, such as those set out in Kofron et al U.S. Pat. No. 4,439,520 and Sowinski et al, each cited above, and here incorporated by reference, each of which suggest emulsion blending. Grain populations, such as those of Lippmann emulsions, that do not contribute to light capture during imagewise exposure are not included within and can be present in additon to the grain populations described above. In addition, features compatible with the construction of reversal dye image forming photographic elements disclosed by *Research Disclosure,* Item 308,119, cited above, and here incorporated by reference, can be employed. Referring to Item 308,119, the emulsions can be washed (Section II), chemically sensitized (Section III), spectrally sensitized (Section IV, but excluding paragraphs G and L), protected by the inclusion of one or more antifoggants and sensitizers (Section VI), and hardeners (Section X). Each of the dye image forming layer units can contain in an emulsion layer or in an adjacent layer one or more couplers, including both couplers that release or form dyes as well as that release other photographically useful groups, such as those set forth in Section VII. The emulsion and other layers of the photographic elements can include coating aids (Section XI), plasticizers and lubricants (Section XII), antistatic layers (Section XIII), and matting agents (Section XVI). Any conventional transparent film support, such as any transparent film support of the various constructions described in Section XVII can be employed. Conventional coating and drying procedures can be employed in forming the emulsion and optional additional layers, such as subbing and overcoat layers, can be employed as described in Section XV. Conventional exposure and processing, illustrated by Sections XVIII and XIX(D), respectively, are contemplated. As is generally well recognized by those skilled in the art, dye forming or releasing couplers can either be incorporated in the photographic elements or incorporated in the photographics during processing.

A specifically preferred reversal dye image forming photographic element construction is as follows:

| |
|---|
| Overcoat Layer |
| Blue Recording Layer Unit |
| Yellow Filter Layer |
| Green Recording Layer Unit |
| Interlayer |
| Red Recording Layer Unit |
| Subbing Layer |
| Photographic Support |

In the foregoing construction the Photographic Support is preferably a transparent cellulose ester, such as cellulose acetate, or a transparent polyester, such as poly(ethylene terephthalate). The Subbing Layer is preferably a natural or modified gelatin layer. Each of the Blue, Green and Red Recording Layer Units consists of two or three emulsion layers, each containing the fastest emulsion layer farthest from the support and the slowest emulsion layer nearest the support. The Interlayer contains an oxidized developing agent scavenger in a natural or modified gelatin layer. The Yellow Filter Layer preferably contains Carey Lea silver or a processing solution removable dye and an oxidized developing agent scavenger in a natural or modified gelatin layer. The Overcoat Layer contains natural or modified gelatin as well as a matting agent, a surfactant and an antistatic agent.

EXAMPLES

Example 1 (AKT-615)

The purpose of this example is to demonstrate a silver bromoiodide emulsion prepared with iodide run in during post-ripening growth step and exhibiting a very low COV.

In a 4-liter reaction vessel was placed an aqueous gelatin solution (composed of 1 liter of water, 1.3 g of alkali-processed gelatin, 4.2 ml of 4N nitric acid solution, 2.44 g of sodium bromide and having pAg of 9.71, and 2.76%, based on the total weight of silver introduced, of PLURONIC TM -17R1, a surfactant satisfying formula II, x=15, x'=15, y=4) and while keeping the temperature thereof at 45° C., 13.3 ml of an aqueous solution of silver nitrate (containing 1.13 g of silver nitrate) and equal amount of an aqueous solution of sodium bromide (containing 0.69 g of sodium bromide) were simultaneously added thereto over a period of 1 minute at a constant rate. Then, into the mixture was added 14.2 ml of an aqueous sodium bromide solution (containing 1.46 g of sodium bromide) after 1 minute of mixing. Temperature of the mixture was raised to 60° C. over a period of 9 minutes. At that time, 33.5 ml of an aqueous ammoniacal solution (containing 1.68 g of ammonium sulfate and 16.8 ml of 2.5N sodium hydroxide solution) was added into the vessel and mixing was conducted for a period of 9 minutes Then, 88.8 ml of an aqueous gelatin solution (containing 16.7 g of alkali-processed gelatin and 5.5 ml of 4N nitric acid solution) was added to the mixture over a period of 2 minutes. After then, 83.3 ml of an aqueous silver nitrate solution (containing 22.64 g of silver nitrate) and 78.7 ml of an aqueous halide solution (containing 12.5 g of sodium bromide and 2.7 g of potassium iodide) were added at a constant rate for a period of 40 minutes. Then, 299 ml of an aqueous silver nitrate solution (containing 81.3 g of silver nitrate) and 284.1 ml of an aqueous halide solution (containing 45 g of sodium bromide and 9.9 g of potassium iodide) were simultaneously added to the aforesaid mixture at constant ramp starting from respective rate of 2.08 ml/min and 2.05 ml/min for the subsequent 35 minutes. Then, 349 ml of an aqueous silver nitrate solution (containing 94.9 g of silver nitrate) and 330 ml of an aqueous halide solution (containing 52.3 g of sodium bromide and 11.5 g of potassium iodide) were simultaneously added to the aforesaid mixture at constant rate over a period of 23.3 minutes. The silver halide emulsion thus obtained contained 12.4 mole % of iodide.

The properties of grains of this emulsion were found to be as follows:

Average Grain ECD: 1.10 μm
Average Grain Thickness: 0.211 μm
Tabular Grain Projected Area: approx. 100%
Average Aspect Ratio of the Grains: 5.2
Average Tabularity of the Grains: 24.6
Coefficient of Variation of Total Grains: 8.2%

Example 2 (MK-92)

The purpose of this example is to demonstrate a very low coefficient of variation silver bromoiodide emulsion prepared by dumping iodide into the reaction vessel during the post-ripening grain growth step.

In a 4-liter reaction vessel was placed an aqueous gelatin solution having a pAg of 9.72 composed of 1 liter of water, 1.3 g of alkali-processed gelatin, 4.2 ml of 4N nitric acid solution, 2.5 g of sodium bromide, and PLURONIC TM -31R1, a surfactant which satisfies formula II, x=25, x'=25, y=7. The surfactant constituted 15.76 percent by weight of the total silver introduced up to the beginning of the post-ripening grain growth step. While keeping the temperature thereof at 40° C., 13.3 ml of an aqueous solution of silver nitrate (containing 1.13 g of silver nitrate) and equal amount of an aqueous halide solution (containing 0.69 g of sodium bromide and 0.0155 g of potassium iodide) were simultaneously added thereto over a period of 1 minute at a constant rate. Then, into the mixture was added 14.2 ml of an aqueous sodium bromide solution (containing 1.46 g of sodium bromide) after 1 minute of mixing. Temperature of the mixture was raised to 50° C. over a period of 6 minutes after 1 minute of mixing. Thereafter, 32.5 ml of an aqueous ammoniacal solution (containing 1.68 g of ammonium sulfate and 15.8 ml of 2.5N sodium hydroxide solution) was added into the vessel and mixing was conducted for a period of 9 minutes. Then, 83.3 ml of an aqueous gelatin solution (containing 25.0 g of alkali-processed gelatin and 5.5 ml of 4N nitric acid solution) were added to the mixture over a period of 2 minutes. After then, 83.3 ml of an aqueous silver nitrate solution (containing 22.64 g of silver nitrate) and 84.7 ml of an aqueous halide solution (containing 14.5 g of sodium bromide and 0.236 g of potassium iodide) were added at a constant rate for a period of 40 minutes. Then, 299 ml of an aqueous silver nitrate solution (containing 81.3 g of silver nitrate) and 298 ml of an aqueous halide solution (containing 51 g of sodium bromide and 0.831 g of potassium iodide) were simultaneously added to the aforesaid mixture at constant ramp starting from respective rate of 2.08 ml/min and 2.12 ml/min for the subsequent 35 minutes. Then, 128 ml of an aqueous silver nitrate solution (containing 34.8 g of silver nitrate) and 127 ml of an aqueous halide solution (containing 21.7 g of sodium bromide and 0.354 g of potassium iodide) were simultaneously added to the aforesaid mixture at constant rate over a period of 8.5 minutes. An iodide solution in the amount of 125 cc containing 3.9 g potassium iodide was added at rate of 41.7 cc/min for 3 minutes followed by a 2 minute hold under unvaried conditions. Thereafter, 221 ml of an aqueous silver nitrate solution (containing 60 g of silver nitrate) and equal amount of an aqueous halide solution (containing 38.2 g of sodium bromide) were simultaneously added to the aforesaid mixture at a constant rate over a period of 16.6 minutes. The silver halide emulsion thus obtained contained 2.7 mole % of iodide.

The properties of grains of this emulsion were found to be as follows:

Average Grain ECD: 0.65 μm
Average Grain Thickness: 0.269 μm
Tabular Grain Projected Area: approx. 100%
Average Aspect Ratio of the Grains: 2.4
Average Tabularity of the Grains: 9
Coefficient of Variation of Total Grains: 9.9%

Examples 3 and 4

The purpose of these examples is to demonstrate the effect of a category S-I surfactant on achieving a low level of dispersity.

EXAMPLE 3 (A Control) (AKT-702)

In a 4-liter reaction vessel was placed an aqueous gelatin solution (composed of 1 liter of water, 1.3 g of oxidized alkali-processed gelatin, 4.2 ml of 4N nitric acid solution, 0.035 g of sodium bromide and having a pAg of 7.92) and while keeping the temperature thereof at 45 C., 13.3 ml of an aqueous solution of silver nitrate (containing 1.13 g of silver nitrate) and a balancing molar amount of an aqueous solution of sodium bromide and sodium iodide (containing 0.677 g of sodium bromide and 0.017 g of sodium iodide) were simultaneously added thereto over a period of 1 minute at a constant rate. Then, into the mixture was added 24.2 ml of an aqueous sodium bromide solution (containing 2.49 g of sodium bromide) after 1 minute of mixing. Temperature of the mixture was raised to 60° C. over a period of 9 minutes. At that time, 33.5 ml of an aqueous ammoniacal solution (containing 1.68 g of ammonium sulfate and 16.8 ml of 2.5N sodium hydroxide solution) was added into the vessel and mixing was conducted for a period of 9 minutes. Then, 88.8 ml of an aqueous gelatin solution (containing 16.7 g of oxidized alkali-processed gelatin and 5.5 ml of 4N nitric acid solution) was added to the mixture over a period of 2 minutes. After then, 83.3 ml of an aqueous silver nitrate solution (containing 22.64 g of silver nitrate) and 81.3 ml of an aqueous sodium bromide solution (containing 14.6 g of sodium bromide) were added at a constant rate for a period of 40 minutes. Then, 299 ml of an aqueous silver nitrate solution (containing 81.3 g of silver nitrate) and 285.3 ml of an aqueous sodium bromide solution (containing 51.4 g of sodium bromide) were simultaneously added to the aforesaid mixture at constant ramp starting from respective rate of 2.08 ml/min and 2.07 ml/min for the subsequent 64 minutes. Then, 349 ml of an aqueous silver nitrate solution (containing 94.9 g of silver nitrate) and 331.9 ml of an aqueous sodium bromide solution (containing 59.8 g of sodium bromide) were simultaneously added to the aforesaid mixture at constant rate over a period of 23.3 minutes. The silver halide emulsion thus obtained was washed.

The properties of grains of this emulsion were found to be as follows:

Average Grain ECD: 4.80 μm

Average Grain Thickness: 0.086 μm
Tabular Grain Projected Area: approx. 100%
Average Aspect Ratio of the Grains: 55.8
Average Tabularity of the Grains: 649
Coefficient of Variation of Total Grains: 36.1%

Example 4 (AKT-244)

Example 3 was repeated, except that PLURONIC TM—31R1, a surfactant satisfying formula II, x =25, x'=25, y=7, was additionally present in the reaction vessel prior to the introduction of silver salt. The surfactant constituted of 12.28 percent by weight of the total silver introduced up to the beginning of the post-ripening grain growth step.

The properties of the grains of this emulsion were found to be as follows:

Average Grain ECD: 1.73 μm
Average Grain Thickness: 0.093 μm
Tabular Grain Projected Area: approx. 100%
Average Aspect Ratio of the Grains: 18.6
Average Tabularity of the Grains: 200
Coefficient of Variation of Total Grains: 7.5%

Example 5 (AKT-612)

The purpose of this example is to illustrate the preparation of a very low coefficient of variation tabular grain emulsion employing a category S-II surfactant.

In a 4-liter reaction vessel was placed an aqueous gelatin solution (composed of 1 liter of water, 1.3 g of alkali-processed gelatin, 4.2 ml of 4N nitric acid solution, 2.44 g of sodium bromide and having a pAg of 9.71 and 1.39 wt %, based on total silver used in nucleation, of PLURONIC TM -L63, a surfactant satisfying formula IV, x=32, y=9, y'=9) and while keeping the temperature thereof at 45° C., 13.3 ml of an aqueous solution of silver nitrate (containing 1.13 g of silver nitrate) and equal amount of an aqueous solution of sodium bromide (containing 0.69 g of sodium bromide) were simultaneously added thereto over a period of 1 minute at a constant rate. Thereafter, after 1 minute of mixing, the temperature of the mixture was raised to 60° C. over a period of 9 minutes. At that time, 33.5 ml of an aqueous ammoniacal solution (containing 1.68 g of ammonium sulfate and 16.8 ml of 2.5N sodium hydroxide solution) was added into the vessel and mixing was conducted for a period of 9 minutes. Then, 88.8 ml of an aqueous gelatin solution (containing 16.7 g of alkali-processed gelatin and 5.5 ml of 4N nitric acid solution) was added to the mixture over a period of 2 minutes. After then, 83.3 ml of an aqueous silver nitrate solution (containing 22.64 g of silver nitrate) and 80 ml of an aqueous halide solution (containing 14 g of sodium bromide and 0.7 g of potassium iodide) were added at a constant rate for a period of 40 minutes. Then, 299 ml of an aqueous silver nitrate solution (containing 81.3 g of silver nitrate) and 285.3 ml of an aqueous halide solution (containing 49.8 g of sodium bromide and 2.5 g of potassium iodide) were simultaneously added to the aforesaid mixture at constant ramp starting from respective rate of 2.08 ml/min and 2.07 ml/min for the subsequent 35 minutes. Then, 349 ml of an aqueous silver nitrate solution (containing 94.9 g of silver nitrate) and 331.1 ml of an aqueous halide solution (containing 57.8 g of sodium bromide and 2.9 g of potassium iodide) were simultaneously added to the aforesaid mixture at constant rate over a period of 23.3 minutes. The silver halide emulsion thus obtained contained 3.1 mole % of iodide. The emulsion was then washed.

The properties of grains of this emulsion were found to be as follows:

Average grain ECD: 1.14 μm
Average Grain Thickness: 0.179 μm
Tabular Grain Projected Area: approx. 100%
Average Aspect Ratio of the Grains: 6.4
Average Tabularity of the Grains: 35.8
Coefficient of Variation of Total Grains: 6.0%

Examples 6 and 7

The purpose of these examples is to demonstrate the effectiveness of a category S-III surfactant in achieving a very low level of dispersity in a tabular grain emulsion.

EXAMPLE 6 (A Control) (MK-103)

No surfactant was employed.

In a 4-liter reaction vessel was placed an aqueous gelatin solution (composed of 1 liter of water, 1.3 g of alkali-processed gelatin, 4.2 ml of 4N nitric acid solution, 2.5 g of sodium bromide and having a pAg of 9.72) and while keeping the temperature thereof at 45 C., 13.3 ml of an aqueous solution of silver nitrate (containing 1.13 g of silver nitrate) and equal amount of an aqueous solution of sodium bromide (containing 0.69 g of sodium bromide) were simultaneously added thereto over a period of 1 minute at a constant rate. Then, into the mixture was added 14.2 ml of an aqueous sodium bromide solution (containing 1.46 g of sodium bromide) after 1 minute of mixing. Temperature of the mixture was raised to 60° C. over a period of 9 minutes after 1 minute of mixing. Thereafter, 32.5 ml of an aqueous ammoniacal solution (containing 1.68 g of ammonium sulfate and 15.8 ml of 2.5N sodium hydroxide solution) was added into the vessel and mixing was conducted for a period of 9 minutes. Then, 172.2 ml of an aqueous gelatin solution (containing 41.7 g of alkali-processed gelatin and 5.5 ml of 4N nitric acid solution) was added to the mixture over a period of 2 minutes. After then, 83.3 ml of an aqueous silver nitrate solution (containing 22.64 g of silver nitrate) and 84.7 ml of an aqueous halide solution (containing 4.2 g of sodium bromide and 0.71 g of potassium iodide) were added at a constant rate for a period of 40 minutes. Then, 299 ml of an aqueous silver nitrate solution (containing 81.3 g of silver nitrate) and 298 ml of an aqueous halide solution (containing 50 g of sodium bromide and 2.5 g of potassium iodide) were simultaneously added to the aforesaid mixture at constant ramp starting from respective rate of 2.08 ml/min and 2.12 ml/min for the subsequent 35 minutes. Then, 128 ml of an aqueous silver nitrate solution (containing 34.8 g of silver nitrate) and 127 ml of an aqueous halide solution (containing 21.3 g of sodium bromide and 1.07 g of potassium iodide) were simultaneously added to the aforesaid mixture at constant rate over a period of 8.5 minutes. Thereafter, 221 ml of an aqueous silver nitrate solution (containing 60 g of silver nitrate) and equal amount of an aqueous sodium bromide solution (containing 37.1 g of sodium bromide and 1.85 g of potassium iodide) were simultaneously added to the aforesaid mixture at constant rate over a period of 16.6 minutes. The silver halide emulsion thus obtained contained 3 mole % of iodide.

The properties of grains of this emulsion were found to be as follows:

Average Grain ECD: 1.81 μm
Average Grain Thickness: 0.122 μm
Tabular Grain Projected Area: approx. 100%

Average Aspect Ratio of the Grains: 14.8
Average Tabularity of the Grains: 121
Coefficient of Variation of Total Grains: 29.5%.

Example 7 (MK-162)

Example 6 was repeated, except that TETRONIC TM -1508, N,N,N',N'-tetrakis{ $H(OCH_2CH_2)_y[OCH(CH_3)CH_2—]_x$} ethylenediamine surfactant, x=26, y=136, was additionally present in the reaction vessel prior to the introduction of silver salt. The surfactant constituted of 11.58 percent by weight of the total silver introduced prior to the post-ripening grain growth step.

The properties of grains of this emulsion were found to be as follows:

Average Grain ECD: 1.20 μm
Average Grain Thickness: 0.183 μm
Tabular Grain Projected Area: approx. 100%
Average Aspect Ratio of the Grains: 6.6
Average Tabularity of the Grains: 36.1
Coefficient of Variation of Total Grains: 9.1%

From viewing the reflectances of the tabular grains of the emulsions of Examples 9 and 10 it was apparent that the Example 10 tabular grain exhibited significantly less grain to grain variations in thickness.

Example 8 (MK-179)

The purpose of this example is to demonstrate the effectiveness of a category S-IV surfactant in achieving a very low level of dispersity in a tabular grain emulsion.

Example 7 was repeated, except that TETRONIC TM -150R8, N,N,N',N'-tetrakis{ $H[OCH(CH_3)CH_2]_x(OCH_2CH_2)y—$} ethylenediamine surfactant, x=18, y=92, was additionally present in the reaction vessel prior to the introduction of silver salt. The surfactant constituted 2.32 percent by weight of the total silver introduced prior to the post-ripening grain growth step.

The properties of grains of this emulsion were found to be as follows:

Average Grain ECD: 1.11 μm
Average Grain Thickness: 0.255 μm
Tabular Grain Projected Area: approx. 100%
Average Aspect Ratio of the Grains: 4.4
Average Tabularity of the Grains: 17
Coefficient of Variation of Total Grains: 9.6%

Examples 9 and 10

The purpose of these examples is to provide a photographic comparison of an emulsion satisfying the requirements of the invention with a comparable emulsion of the type found in the art.

Example 9 (MK202)

Example 9 of Saitou et al U.S. Pat. No. 4,797,354 was repeated, except that 3 percent iodide based on the total moles of silver was added to the emulsion at 70% of the precipitation. At 70% of the precipitation the morphology and COV are well established so that the addition of iodide did not change the COV.

In a 4-liter reaction vessel was placed an aqueous gelatin solution (having pBr of 1.42 and composed of 1 liter of water, 7 g of deionized alkali-processed gelatin, 4.5 g of potassium bromide, and 1.2 ml of 1N potassium hydroxide solution) while keeping the temperature of the solution at 30° C. Twenty-five ml of an aqueous solution of silver nitrate (containing 8.0 g of silver nitrate) and 25 ml of an aqueous solution of potassium bromide (containing 5.8 g of potassium bromide) were simultaneously added to the reaction vessel over a period of 1 minute at a rate of 25 ml/min. Then, an aqueous gelatin solution (composed of 1950 ml of water, 90 g of deionized alkali-processed gelatin, 15.3 ml of 1N aqueous potassium hydroxide solution, and 3.6 g of potassium bromide) was further added to the reaction vessel, and the temperature of the mixture was raised to 75° C. over a period of 10 minutes. Thereafter, ripening was performed for 50 minutes.

The mixture was then transferred to a 12-liter vessel, into which, 200 ml of an aqueous silver nitrate solution (containing 90 g of silver nitrate) were added at a rate of 20 ml/min. Twenty-five seconds after commencing the addition of the silver nitrate the 12-liter vessel, 191.6 ml of an aqueous potassium bromide solution (containing 61.2 g of potassium bromide) were added to the 12-liter vessel at a rate of 20 ml/min., the additions of both solutions being finished at the same time. Thereafter, the resultant mixture was stirred for 2 minutes, then 1336 ml of an aqueous silver nitrate solution (containing 601.9 g of silver nitrate) and 1336 ml of a potassium bromide solution (containing 425.4 g of potassium bromide) were simultaneously added to the aforesaid mixture at a rate of 40 ml/min for the first 20 minutes and 60 ml/min for the subsequent 8.9 minutes.

An iodide solution in the amount of 750 ml containing 29.23 g potassium iodide was added at a rate of 250 ml/min for 3 minutes followed by a 2 minute hold under unvaried conditions. Subsequently 664 ml of an aqueous silver nitrate solution (containing 299.1 g of silver nitrate) and an equal volume of a potassium bromide solution (containing 211.4 g potassium bromide) were simultaneously added at a rate of 40 ml/min for 16.6 minutes. Then, after stirring the mixture for 1 minute, the silver halide emulsion thus obtained was washed and redispersed.

The properties of grains of this emulsion were as follows:

Average Grain ECD: 1.18 μm
Average Grain Thickness: 0.187 μm
Average Aspect Ratio: 6.31
Average Tabularity: 33.7
Coefficient of Variation of Total Grains: 32.6%

When the coefficient of variation of only the hexagonal tabular grains was measured, it was approximately 13%.

Example 10 (MK219)

In a 4-liter reaction vessel were placed an aqueous gelatin solution (having a pAg of 9.39 and composed of 1 liter of water, 0.83 g of oxidized alkali-processed gelatin, 4.0 ml of 4N nitric acid solution, and 1.12 g of sodium bromide) and 14.76 wt %, based on total silver introduced up to the beginning of post-ripening grain growth stage, of PLURONIC TM -31R1 (which satisfies formula II with x=25, y=7 and x'=25). While keeping the temperature of the reaction vessel at 45° C., 5.3 ml of an aqueous solution of silver nitrate (containing 0.725 g of silver nitrate) and an equal volume of an aqueous solution of sodium bromide (containing 0.461 g of sodium bromide) were simultaneously added over a period of 1 minute at a constant rate. Then, into the mixture were added 14.2 ml of an aqueous sodium bromide solution (containing 1.46 g of sodium bromide) after 1 minute of mixing. The temperature of the mixture was raised to 60° C. over a period of 9 minutes. At that time, 65 ml of an aqueous ammoniacal solution (containing 3.36 g of ammonium sulfate and 26.7 ml of 2.5N sodium hydroxide solution) were added into the vessel, and mixing was conducted for a period of 9 minutes. Then, 83.3 ml of an aqueous gelatin solution (containing 16.7 g of oxidized alkali-processed gelatin and 11.4 ml of 4N nitric acid solution was added to the mixture over a period of 2 minutes. Thereafter, 83.3 ml of an aqueous silver nitrate solution (containing 22.67 g of silver nitrate) and 81.3 ml of an aqueous sodium bromide solution (containing 14.6 g of sodium bromide) were added at a constant rate for a period of 40 minutes. Then 299 ml of an aqueous silver nitrate solution (containing 81.3 g of silver nitrate) and 285.8 ml of an aqueous sodium bromide solution (containing 51.5 g of sodium bromide) were simultaneously added to the aforesaid mixture at constant ramp starting from respective rate of 2.08 ml/min and 2.12 ml/min for the subsequent 35 minutes. Then, 16.3 ml of an aqueous silver nitrate solution (containing 4.43 g of silver nitrate) and 15.6 ml of an aqueous sodium bromide solution (containing 2.81 g of sodium bromide) were simultaneously added to the aforesaid mixture at constant rate over 1.08 minutes. An iodide solution in the amount of 125 ml containing 4.87 g potassium iodide was added at a rate of 41.7 ml/min for 3 minutes followed by a 2 minute hold under unvaried conditions. Subsequently, 172.2 ml of an aqueous silver nitrate solution (containing 46.8 g of silver nitrate) and an equal volume of an aqueous sodium bromide solution (containing 31.0 g of sodium bromide) were simultaneously added to the aforesaid mixture at constant rate over a period of 20.7 minutes. The silver halide emulsion thus obtained was washed and redispersed.

The properties of grains of this emulsion were as follows:

Average Grain ECD: 1.2 μm
Average Grain Thickness: 0.194 μm
Average Aspect Ratio of the Grains: 6.2
Average Tabularity of the Grains: 31.8
Coefficient of Variation of Total Grains: 4.5%

Sensitization

Each of the emulsions of Examples 9 and 10 were optimally sensitized. Although the ECD, thickness and iodide placement of the tabular grains were essentially similar, the sensitizations that produced optimum photographic response for the emulsions differed, reflecting differences in grain size distributions.

The emulsion of Example 9 exhibited optimum photographic performance with the following sensitization: 0.95 millimole of Dye A (5,5'-dichloro-3,3'-di(3-sulfopropyl)thiacyanine, sodium salt) per mole silver, 1.8 mg of sodium aurous(I)dithiosulfate dihydrate per mole silver, 0.9 mg sodium thiosulfate pentahydrate per mole silver, and 40 mg of 3-(2-methylsulfamoylethyl)-benzothiazolium tetrafluoroborate per mole silver. The emulsion and sensitizers were heated to 65° C. and held for 15 minutes to complete sensitization.

The emulsion of Example 10 exhibited optimum photographic performance with the following sensitization: 0.90 millimole Dye A, 2.7 mg sodium aurous(I) dithiosulfate dihydrate, 1.35 mg sodium thiosulfate pentahydrate and 40 mg 3-(2-methylsulfamoylethyl)benzothiazolium tetrafluoroborate per mole silver, the emulsion being heated to 65° C. and held for 15 minutes to complete sensitization.

Coating Processing

The sensitized emulsions were each coated onto a clear cellulose acetate film support. Each emulsion layer contained on a per square decimeter basis 3.77 mg silver, 9.68 mg Coupler X (benzoic acid, 4-chloro-3-{[2-[4-ethoxy-2,5-dioxo-3-(phenyl)methyl -1-imidazolidinyl]-3-(4-methoxyphenyl)-1,3-dioxopropyl-]amino}dodecyl ester), 16.14 mg gelatin and 0.061 mg 1,2,4-triazaindolizine was coated. A gel overcoat of 21.52 mg gelatin per square decimeter and bis(vinylsulfonylmethy) ether gelatin hardener was coated above the emulsion layer.

The coated samples were exposed through a step tablet, a Wratten 2B TM filter and a 1.0 neutral density filter to a 5500° K. light source for 1/50th second and then processed in the Kodak Ektachrome TM E6 process described in the *British Journal of Photography*, 1977, 194–197.

Sensitometric results are summarized below in Table I.

TABLE I

| Ex. | COV | Dmax | Speed (log E) | Contrast | Grain |
|---|---|---|---|---|---|
| 9 | 32.6% | 1.02 | 0 | 1.00 | 0 |
| 10 | 4.5% | 1.10 | −0.15 | 1.41 | −9GU |

The low COV emulsion of Example 10 satisfying the requirements of the invention exhibited a higher maximum density and a higher contrast than the control emulsion of Example 9, which is representative of the lowest conventional COV's in tabular grain emulsions. Grain unit comparisons, showing a distinct advantage for the emulsion of Example 10, were based on comparisons of the lowest contrast normalized granularities (granularity divided by contrast). Fog comparisons, not included in Table I, showed the Example 10 emulsion to have a lower fog than the Example 9 control emulsion. While the emulsion of the invention was slightly slower than the control emulsion, this deficiency is readily rectified simply by increasing the ECD of the emulsion during precipitation. It is generally accepted that a one stop (0.30 log E) increase in speed results in an increase in granularity of 7 grain units. Thus, it is apparent that the emulsion of the invention exhibits a significant granularity advantage over the control emulsion, equivalent to a speed advantage of about one half (0.15 log E) stop.

Examples 11 and 12

The purpose of these example is to corroborate the advantages of the invention demonstrated above utilizing invention and control emulsions of varied structure.

Example 11

A "run-dump" silver bromoiodide was prepared as described by Example 2, but the following variations: The temperatures of grain nucleation and growth were 45° C. and 60° C., respectively, with the temperature increase occurring over a period of 9 minutes. Only 75 percent of the surfactant was added to the kettle before nucleation. The rest of the surfactant was added to the aqueous gelatin solution added prior to the grain growth step. The aqueous gelatin solution was diluted with 161 ml more water and contained deionized gelatin. The nucleation salt solution contained 30 percent less potassium iodide. The amount of ammonium sulfate used was 48 percent less, and instead of using potassium iodide solution, 0.0238 mole of a preformed silver iodide emulsion (approx. 0.05 μm ECD) was added after the growth period.

The emulsion contained 2.7 mole percent iodide based on silver, and the properties of grains of this emulsion were as follows:

Average Grain ECD: 1.12 μm
Average Grain Thickness: 0.201 μm
Average Aspect Ratio of the Grains: 5.6
Average Tabularity of the Grains: 27.7
Coefficient of Variation of Total Grains: 9%

The emulsion of Example 11 exhibited optimum photographic performance with the following sensitization: 100 mg of sodium thiocyanate, 1.15 millimole Dye B (anhydro-5'-chloro-3,3'-bis(3-sulfopropyl)naptho[1,2-d]oxazolothiacyanine hydroxide triethylamine), 2.5 mg sodium aurous(I) dithiosulfate dihydrate, 1.25 mg sodium thiosulfate pentahydrate, and 24.2 mg 3-(2-methylsulfamoylethyl)benzothiazolium tetrafluoroborate per mole silver with the emulsion being heated to 75° C. and held at this temperature for 15 minutes to complete sensitization. Because this emulsion contained fewer fine and nontabular grains, it required smaller amounts of sensitizers for optimum sensitization.

Example 12

A conventional "run-dump" silver bromoiodide emulsion containing 3 mole percent iodide was employed as a control.

The properties of grains of this emulsion were as follows:

Average Grain ECD: 1.95 μm
Average Grain Thickness: 0.097 μm
Average Aspect Ratio of the Grains: 20.1
Average Tabularity of the Grains: 207
Coefficient of Variation of Total Grains: 31%

The emulsion of Example 12 exhibited optimum photographic performance with the following sensitization: 150 mg sodium thiocyanate, 1.60 millimole Dye B, 2.8 mg sodium aurous(I) dithiosulfate dihydrate, 2.18 mg sodium thiosulfate pentahydrate, 10 mg 3-methylbenzothiazolium iodide, and 251 mg potassium chloride per mole silver with the emulsion being heated to 70° C. and held at this temperature for 10 minutes to complete sensitization.

Coating and Processing

The sensitized emulsions were each coated onto a clear cellulose acetate film support. Each emulsion layer contained on a per square decimeter basis 8.07 mg silver. The emulsion layers additionally contained 14.2 mg Coupler Y (benzoic acid, 4-chloro-3-{[2-[4-ethoxy-2,5-dioxo-3-(phenyl)methyl-1-imidazolidinyl]-4,4'-dimethyl-1,3-dioxopropyl]amino}dodecyl ester), 23.7 mg gelatin, and 0.131 mg 4-hydroxy-6-methyl-1,3,3a,7-tetraazaindene per square decimeter. A gelatin overcoat of 23.7 mg/dm$^2$ with bis(vinylsulfonylmethyl) ether as hardener was coated over the emulsion layer. The coated samples were exposed through a step tablet as described in connection with Examples 9 and 10 and then processed in the Kodak Ektachrome TM E6 process described in the *British Journal of Photography*, 1977, 194–197.

Sensitometric results are summarized below in Table II.

TABLE II

| Ex. | COV | Dmax | Speed (log E) | Contrast | Grain |
|---|---|---|---|---|---|
| 11 | 9% | 2.38 | −0.10 | 1.07 | −5GU |
| 12 | 31% | 2.40 | 0 | 1.00 | 0 |

By comparison of the data of Tables I and II it is apparent that the advantages discussed above in connection Table I are generally corroborated with the varied emulsions compared in Table II, with the speed-granularity advantage of the photographic element prepared using the Example 11 emulsion being about one third stop.

Examples 13 and 14

In the description of the emulsions above nucleation is undertaken in the presence of a polyalkylene oxide block copolymer surfactant with silver halide solvents, such as thiocyanate, thioether or ammonia, optionally being introduced to reduce grain nuclei dispersity before undertaking grain growth. These examples have as their purpose to demonstrate the compatibility of a silver halide solvent with the surfactant during grain nucleation while still achieving desirable tabular grain characteristics, including total grain coefficients of less than 15 percent.

Example 13

Comparative Emulsion 13A (SHK570)

A 2.7 mole percent iodide silver bromoiodide tabular grain emulsion was precipitated by a double jet procedure.

The following procedure produced 1 mole of total silver precipitated: To achieve grain nucleation 0.0083 mole of silver was introduced for 1 minute as 2N silver nitrate while maintaining a pAg of 9.7 by adding salt solution A (1.97N sodium bromide and 0.2N potassium iodide) to a vessel containing 833 ml of an aqueous solution of 1.87 g/L bone gelatin and 2.5 g/L sodium bromide at a pH of 1.85 and a temperature of 45° C. This was followed by a post-nucleation ripening step. After adjusting pAg to 9.8 by sodium bromide addition, the temperature was raised to 60 ° C. and 13.85 ml of 0.76 mole/L ammonium sulfate was added. The pH of the vessel was brought up to 9.5 by the addition of 2.5N sodium hydroxide, followed by a 9 minute hold. Further grain growth was then undertaken. The pAg was then adjusted to 9.2 by addition of an aqueous gelatin solution containing 100 g/L bone gelatin, and the pH was adjusted to 5.8. Grain growth was then undertaken at a pAg of 9.2 for 55.83 minutes by accelerated flows of 1.6N silver nitrate and salt solution B (1.66N sodium bromide and 0.0168N potassium iodide). After 3 minutes, the remaining 29.5 percent of total silver was precipitated with 1.6N silver nitrate and 1.68N sodium bromide at a pAg of 8.7 for 13.3 minutes.

The resultant emulsion was washed by ultrafiltration, and the pH and pAg were adjusted to 5.5 and 8.2, respectively. Emulsion properties are summarized in Table III below.

Comparative Emulsion 13B (SHK589)

This emulsion was precipitated like Comparative Emulsion 13A, except that a thioether, 1,8-dihydroxy-1,3-dithiaoctane was added to the vessel before the start of the precipitation. The amount of the thioether added was 6.93 gm per mole of the total silver introduced up to the beginning of the post-ripening grain growth step. Emulsion properties are summarized in Table III below.

Invention Emulsion 13C (SHK591)

This emulsion was precipitated like Comparative Emulsion 13A, except that Pluronic-31R1 TM, a surfactant satisfying formula II, x=25, x'=25, y=7, was added to the reaction vessel before the start of the precipitation. The amount of the surfactant added was 9.84 percent by weight of the total silver introduced up to the beginning of the post-ripening grain growth step. Emulsion properties are summarized in Table III below.

Invention Emulsion 13D (SHK590)

This emulsion was prepared like Comparative Emulsion 13A, except that thioether was added as in Comparative Emulsion 13B and Pluronic-31R1 TM surfactant was added as in Invention Emulsion 13C. Emulsion properties are summarized in Table III.

TABLE III

| Emuls. | ECD μm | t μm | ECD t | T | COV % | Surfactant/ Thioether |
|---|---|---|---|---|---|---|
| 13A | 1.58 | 0.084 | 18.8 | 223.9 | 25 | No/No |
| 13B | 1.69 | 0.132 | 12.8 | 97.0 | 25 | No/Yes |
| 13C | 1.39 | 0.128 | 10.9 | 84.8 | 12 | Yes/No |
| 13D | 1.35 | 0.169 | 8.0 | 47.3 | 13 | Yes/Yes |

From Table III it is apparent that average total grain coefficients of variation of relatively high in the absence of the surfactant during nucleation. Only Emulsions 13C and 13D exhibit coefficients of variation that satisfy the requirements of the invention. By comparing Emulsions 13B and 13C it is clear that replacing the surfactant with a thioether during nucleation has the effect of increasing grain size (ECD), grain thickness (t) and coefficient of variation (COV) while reducing average aspect ratio (ECD/t) and tabularity (T). Emulsion 13D demonstrates that the presence of thioether along with surfactant during grain nucleation is compatible with the requirements of the invention.

Example 14

To a vessel containing 6 L of water were added 4 g of a low methionine deionized gelatin, 0.25 g of 3,6-dithia-1,8-octanediol, 7.116 g of Pluronic L-43 TM (a surfactant satisfying formula IV, x=19, y=6, y'=6) sufficient acid to adjust the pH to 3.5 sufficient sodium bromide solution to adjust the pAg to 9.6. To this mixture at a temperature of 40° C. were simultaneously added a solution of silver nitrate (0.9 mole/L) and a 4 mole percent iodide sodium bromide solution over a period of 15 seconds, such that 0.072 mole of silver bromoiodide was nucleated.

After nucleation the emulsion was held at 40° C. for 15 minutes. At this point, 122 g of low methionine deionized gelatin was added, the pH adjusted to 4.5 and double-jet precipitation resumed using 2.5 moles per liter of silver nitrate and the same halide salt solution as above while maintaining a pAg of 9.5, precipitation being continued until 7 moles of total silver bromoiodide had been precipitated.

The thus obtained tabular silver bromoiodide grains had the following physical characteristics:

ECD: 0.4523 μm,
t: 0.070 μm,
Av. ECD/t: 6.46,
Av. ECD/$t^2$: 92.3, and
Overall COV: 13%.

Example 15

The purpose of this example is to demonstrate that the color reversal photographic elements are capable of exhibiting improved dye image sharpness in an underlying dye image forming layer unit when a high tabularity (T>25%), highly monodisperse (COV<15%) emulsion satisfying the requirements of this invention (hereinafter referred to as the high tabularity monodispersed emulsion) is substituted for a conventional emulsion layer in an overlying dye image forming layer unit. A significant contribution to the increase in sharpness of the dye image of the underlying dye image forming layer unit is attributed to the fact that the high tabularity monodispersed emulsions prepared in the presence of a polyalkylene oxide block copolymer surfactant also exhibit the unusual property of having a very high proportion of the total grain projected area (excluding grains too small to contribute to light scatter) accounted for by tabular grains. More specifically, the high tabularity monodispersed emulsions herein disclosed contribute to increased sharpness in an underlying dye image forming layer unit by reason of having accounted for by tabular grains greater than 97 percent (optimally greater than 98 percent) of total grain projected area, where grains having an equivalent ciruclar diameter too small to scatter light are, of course, excluded from total grain projected area.

Control Color Reversal Element

A conventional color reversal photographic element (hereinafter referred to as CR-1) of the following overall structure was prepared:

| |
|---|
| Protective Layer Unit |
| Fast Yellow Emulsion Layer |
| Slow Yellow Emulsion Layer |
| Interlayer Unit |
| Fast Magenta Emulsion Layer |
| Slow Magenta Emulsion Layer |
| Interlayer Unit |
| Fast Cyan Emulsion Layer |
| Slow Cyan Emulsion Layer |
| Interlayer Unit |
| Antihalation Layer Unit |
| Transparent Film Support |

In CR-1 the Slow Yellow Emulsion Layer was constructed as follows: A tabular grain silver bromoiodide emulsion was employed. The emulsion contained 3 mole percent iodide, based on silver. Grain coverage was 431 mg/$m^2$. Gelatin coverage was 2368 mg/$m^2$. The grains exhibited an average grain ECD of 1.14 μm and an average grain thickness (t) of 0.087 μm, providing an average aspect ratio (ECD/t) of 13.1 and an average tabularity (T) of 150. Tabular grains accounted for 88.4 percent of the total projected area of grains having an equivalent circular diameter of at least 0.2 μm. The grains are relatively monodispersed, with the grain coefficient of variation being estimated to be somewhat above 20 percent.

The emulsion was optimally sulfur and gold sensitized in the presence of 3-methylbenzothiazolium iodide acting as a finish modifier and spectrally sensitized to the blue region of the spectrum with a conventional monomethine cyanine dye (anhydro-5'-chloro-3,3'-bis(3-sulfopropyl)naphtho[1,2-d]oxazolothiacyanine hydroxide, triethylamonium salt). In addition the emulsion contained a conventional yellow dye forming coupler, a conventional arylhydrazide reducing agent, a conventional metal ion scavenger and a combination of conventional antifoggants.

Invention Color Reversal Element

A second color reversal element (CR-2) having the same layer sequence as described above and an essentially similar composition was prepared, but with the following Slow Yellow Layer construction: Again a tabular grain silver bromoiodide emulsion was employed containing 3 mole percent iodide, based on silver. Similar silver and gelatin coating coverages were employed as in the CR-1. The grains exhibited an average grain ECD of 1.115 μm and an average grain thickness (t) of 0.134 μm, providing an average aspect ratio (ECD/t) of 8.34 and an average tabularity (T) of 62.2. Tabular grains accounted for 98.3 percent of total grain projected area (again excluding grains having an equivalent circular diameter of less than 0.2 μm). The grains are monodis-persed, with the grain coefficient of variation being 14 percent.

The following preparation procedure was employed to obtain the emulsion grains: In a 4-liter reaction vessel was placed an aqueous gelatin solution (composed of 1 liter of water, 1.3 g of alkali-processed gelatin , 3.9 ml of 4N nitric acid solution, 2.44 g of sodium bromide and having pAg of 9.71 and 2.78 wt %, based on total silver used in nucleation, of PLURONIC-L43 TM , a surfactant satisfying formula IV (x=19, y=6, y'=6) and, while keeping the temperature thereof at 45° C., 4.2 ml of an aqueous solution of silver nitrate (containing 1.13 g of silver nitrate) and an equal amount of an aqueous solution of sodium bromide (containing 0.76 g of sodium bromide) were simultaneously added thereto over a period of 1 minute at a constant rate. Thereafter, after 1 minute of mixing, the temperature of the mixture was raised to 60° C. over a period of 9 minutes, and mixing was conducted for another period of 9 minutes. Then, 250 ml of an aqueous gelatin solution (containing 16.7 g of alkali-processed gelatin and 6.4 ml of 2.5N sodium hydroxide) were added to the mixture over a period of 2 minutes. Afterward, 33.3 ml of an aqueous silver nitrate solution (containing 9.06 g of silver nitrate) and 31.7 ml of an aqueous sodium bromide solution (containing 5.52 g or sodium bromide and 0.29 g of potassium iodide were added at a constant rate for a period of 20 mintues. Then, 307.3 ml of an aqueous silver nitrate solution (containing 83.5 g of silver nitrate) and 292.6 ml of an aqueous sodium bromide solution (containing 51.0 g of sodium bromide and 2.72 g of potassium iodide) were simultaneously added to the aforesaid mixture at constant ramp starting from respective rates of 1.67 and 1.68 ml/min for the subsequent 36.9 minutes. Then, 393 ml of an aqueous silver nitrate solution (containing 106.8 g of silver nitrate) and 372.5 ml of an aqueous sodium bromide solution (containing 64.9 g of sodium bromide and 3.46 g of potassium iodide) were simultaneously added to the aforesaid mixture at a constant rate over a period of 26.2 minutes.

The emulsion was chemically and spectrally sensitized similarly as that of CR-1 and coated with the same addenda at the same coating coverages as in CR-1.

Sharpness Comparisons

CR-1 and CR-2 were identically exposed and processed as described above in Example 9. As is typical of color reversal photographic elements of the layer construction shown above, the cyan dye image record of CR-1 was significantly lower in sharpness than the remaining yellow and magenta dye image records. This is attributable to the cyan dye image forming layers being farthest from the exposure source than the remaining image dye forming layers. Reduced cyan image sharpness was particularly noticeable within the frequency range of about 8 to 60 cycles per mm. In this frequency range the cyan dye image acutance of CR-2 was significantly higher, with modulation transfer functions (MTF) ranging from 2 to 5 percent higher, with an overall MTF advantage in this frequency range being estimated at approximately 3 percent. In CR-2 the sharpness of the cyan dye image record more nearly approached that of the yellow and magenta dye image records.

From further investigations it was determined that the cyan dye image record sharpness improvements declined only slightly in the 15 to 30 percent coefficient of variation range. In this range the cyan image dye record sharpness still remained superior to that of the control. It was concluded that a dye image record of superior sharpness could be obtained when at least one overlying emulsion layer contained tabular grains accounting for greater than 97 percent of total grain projected area and optimally greater than 98 percent of total grain projected area, excluding from the total grain projected area grains too small to scatter light. In the slow yellow emulsion layers above the total grain projected area would have been essentially the same with or without the exclusion of smaller diameter grains. However, it is recognized that it is common practice to blend relatively small equivalent circular diameter grains in color reversal emulsion layers for the purpose of modifying imaging response (note, for example, Sowinski et al U.S. Pat. No. 4,656,122). Lippmann emulsions, well known to be optically transparent (i.e., nonscattering) are commonly blended with larger diameter emulsions for characteristic curve shape control. Grains having equivalent circular diameters of less than 0.2 μm do not significantly scatter light of wavelengths longer than 500 nm and hence can be excluded in calculating the total grain projected area of layers overlying green and/or red recording emulsion layers. When an underlying emulsion layer is intended to record blue light, then only grains having an equivalent circular diameter of less than 0.15 μm (optimally <0.10 μm) can be excluded in determining the total grain projected area of an overlying high tabularity monodispersed emulsion layer satisfying the requirements of the invention. Regardless of the recording wavelengths of underlying emulsion layers, preferred photographic elements are those in which the tabular grain >97% (optimally >98%) of total grain projected area criteria set forth above are satisfied excluding only grains having equivalent circular diameters of less than 0.15 μm.

In still further investigations it was observed that ideal tabular grain thicknesses in the overlying blue recording yellow image dye forming emulsion layers were in the range of from 0.1 to 0.15 μm, optimally from 0.12 to 0.14 μm. In these thickness ranges the tabular grains exhibited minimum reflection of green and red light, thereby improving the speed of the underlying magenta and cyan dye image forming emulsion layers. There was also a statistically significant increase in the sharpness of the magenta and cyan dye image records in these ranges of tabular grain thicknesses in the overlying blue recording yellow image dye tabular grain emulsion layer.

The invention has been described in detail with particular reference to preferred embodiments thereof, but it will be understood that variations and modifications can be effected within the spirit and scope of the invention.

What is claimed is:

1. A multicolor photographic element capable of forming a viewable reversal dye image comprising
   - a support and, coated on the support,
   - a blue recording yellow dye image forming layer unit,
   - a green recording magenta dye image forming layer unit,
   - a red recording cyan dye image forming layer unit,
   - each of the layer units containing in at least one layer a silver halide emulsion having a grain halide content of from 0 to 5 mole percent chloride, from 0.1 to 20 mole percent iodide, and from 80 to 99.9 mole percent bromide, based on total silver,
   - at least the at least one layer of at least one layer unit is a tabular grain emulsion layer in which
   - the coefficient of variation of the tubular grain emulsion is less than 15 percent, based on the total grain population of the emulsion, and
   - the total grain population of the tabular grain emulsion consists essentially of tabular grains having a mean thickness of less than 0.3 μm and a mean tabularity of greater than 25.

2. A multicolor photographic element capable of forming a viewable reversal dye image according to claim 1 further characterized in that the tabular grain emulsion layer is in one occurrence in the blue recording yellow dye image forming layer unit.

3. A multicolor photographic element capable of forming a viewable reversal dye image according to claim 2 further characterized in that the blue recording yellow dye image forming layer unit is located to overlie the green and red image forming layer units.

4. A multicolor photographic element capable of forming a viewable reversal dye image according to claim 1 or 2 further characterized in that the tabular grain emulsion layer in the at least one layer unit overlies at least one other emulsion layer in the same layer unit.

5. A multicolor photographic element capable of forming a viewable reversal dye image according to claim 1 or 2 further characterized in that the tabular grains have a coefficient of variation of less than 10 percent.

6. A multicolor photographic element capable of forming a viewable reversal dye image according to claim 1 or 2 further characterized in that the tabular grains have an average aspect ratio of up to 100.

7. A multicolor photographic element capable of forming a viewable reversal dye image according to claim 1 or 2 further characterized in that the tabular grains have an average aspect ratio in the range of from 5 to 50.

8. A multicolor photographic element capable of forming a viewable reversal dye image according to claim 1 or 2 further characterized in that the tabular grains are comprised of from 1 to 15 mole percent iodide, based on total silver.

9. A multicolor photographic element capable of forming a viewable reversal dye image according to claim 1 or 2 further characterized in that the tabular grains are silver bromoiodide grains.

10. A multicolor photographic element capable of forming a viewable reversal dye image according to claim 1 or 2 further characterized in that the tabular grains contain less than 10 mole percent iodide.

11. A multicolor photographic element capable of forming a viewable reversal dye image according to claim 1 or 2 further characterized in that at least one polyalkylene oxide block copolymer capable of reducing tabular grain dispersity is present.

12. A multicolor photographic element capable of forming a viewable reversal dye image according to claim 11 further characterized in that the polyalkylene oxide block copolymer is selected to satisfy one of the formulae $$\text{LAO1—HAO1—LAO1,} \quad \text{(S-I)}$$

$$\text{HOA2—LAO2—HAO2,} \quad \text{(S-II)}$$

$$(\text{H—HAO3})_z\text{—LOL—}(\text{HAO3—H})_{z'}, \quad \text{(S-III)}$$

and $$(\text{H—LAO4})_z\text{—HOL—}(\text{LAO4—H})_{z'} \quad \text{(S-IV)}$$

where
   - LAO1 and LAO4 in each occurrence represents a terminal lipophilic alkylene oxide block unit,
   - HAO2 and HAO3 in each occurrence presents a terminal hydrophilic alkylene oxide block unit,
   - HAO1 and HOL each represents a hydrophilic alkylene oxide block linking unit,
   - LAO2 and LOL each represents a lipophilic alkylene oxide block linking unit,
   - z is 2, and
   - z' is 1 or 2,
   - each block linking unit constitutes from 4 to 96 percent of the block copolymer on a weight basis,
   - the block copolymer S-I has a molecular weight of from 760 to less than 16,000,
   - the block copolymer S-II has a molecular weight of from 1,000 to 30,000,
   - the block copolymer S-III has a molecular weight of from 1,100 to 60,000, and
   - the block copolymer S-IV has a molecular weight of from 1,100 to 50,000.

13. A multicolor photographic element capable of forming a viewable reversal dye image according to claim 12 further characterized in that
   - (a) each lipophilic alkylene oxide block contains repeating units satisfying the formula:

$$-(\text{O}\overset{\overset{\displaystyle R^9}{|}}{\text{C}}\text{HCH}_2)-$$

where
   - $R^9$ is a hydrocarbon containing from 1 to 10 carbon atoms, and
   - (b) each hydrophilic alkylene oxide block contains repeating units satisfying the formula:

$$-(\text{O}\overset{\overset{\displaystyle R^{10}}{|}}{\text{C}}\text{HCH}_2)-$$

where $R^{10}$ is hydrogen or a hydrocarbon containing from 1 to 10 carbon atoms substituted with at least one polar substituent.

14. A multicolor photographic element capable of forming a viewable reversal dye image according to claim 12 further characterized in that the polyalkylene oxide block copolymer satisfies the formula:

$$HO-(\overset{CH_3}{\overset{|}{C}}HCH_2O)_x-(CH_2CH_2O)_y-(CH_2\overset{CH_3}{\overset{|}{C}}HO)_{x'}-H$$

where x and x' are each in the range of from 6 to 120 and y is in the range of from 2 to 300.

15. A multicolor photographic element capable of forming a viewable reversal dye image according to claim 12 further characterized in that the polyalkylene oxide block copolymer satisfies the formula:

$$HO-(CH_2CH_2O)_y-(\overset{CH_3}{\overset{|}{C}}HCH_2O)_x-(CH_2CH_2O)_{y'}-H$$

where x is in the range of from 13 to 490 and y and y' are in the range of from 1 to 320.

16. A multicolor photographic element capable of forming a viewable reversal dye image according to claim 1 further characterized in that the tabular grain emulsion layer is located in at least one of the green recording magenta dye image forming layer unit and the red recording cyan dye image forming layer unit and the tabular grains have a thickness of less than 0.2 μm.

17. A multicolor photographic element according to claim 1 further characterized in that tabular grains in the at least one tabular grain emulsion layer account for greater than 97 percent of the total projected area of grains having an equivalent circular diameter of at least 0.2 μm.

18. A multicolor photographic element according to claim 17 further characterized in that tabular grains in the at least one tabular grain emulsion layer account for greater than 98 percent of the total projected area of grains having an equivalent circular diameter of at least 0.15 μm.

19. A multicolor photographic element according to claim 17 further characterized in that the at least one tabular grain emulsion layer is positioned to receive exposing radiation prior to at least one other emulsion layer.

20. A multicolor photographic element according to claim 17 further characterized in that the at least one tabular grain emulsion layer is a blue recording yellow dye image forming layer.

21. A multicolor photographic element capable of forming a viewable reversal dye image comprising a support and, coated on the support, a blue recording yellow dye image forming layer unit, a green recording magenta dye image forming layer unit, a red recording cyan dye image forming layer unit, characterized in that in at least the blue recording yellow dye image forming layer unit silver bromoiodide emulsions having a grain iodide content of from 1 to 15 mole percent, based on total silver, form at least two emulsion layers, one of the emulsion layers overlying at least one other emulsion layer, and the overlying emulsion layer is a tabular grain emulsion layer in which the coefficient of variation of the tabular grain emulsion is less than 10 percent, base don the total grain population of the emulsion, the total grain population of said emulsion consists essentially of tabular grains having a mean thickness of less than 0.3 μm, and the vehicle is comprised of a gelatino-peptizer containing at least 30 micromoles per gram of methionine and a polyalkylene oxide block copolymer surfactant having a molecular weight in the range of from 760 to 16,000 satisfying the formula:

LAO1—HAO1—LAO1 where

LAO1 in each occurrence represents a terminal lipophilic alkylene oxide block unit containing at least six $-CH(CH_3)CH_2O-$ repeating units and HAO1 represents a hydrophilic alkylene oxide block linking unit containing $-CH_2CH_2O-$ repeating units forming 5 to 85 percent of the total surfactant molecular weight.

22. A multicolor photographic element capable of forming a viewable reversal dye image according to claim 21 further characterized in that the polyalkylene oxide block copolymer surfactant has a molecular weight in the range of from 1000 to 10,000, LAO1 in each occurrence contains at least seven $-CH(CH_3)CH_2O-$ repeating units, and HAO1 forms from 10 to 80 percent of the total surfactant molecular weight.

23. A multicolor photographic element capable of forming a viewable reversal dye image comprising a support and, coated on the support, a blue recording yellow dye image forming layer unit, a green recording magenta dye image forming layer unit, a red recording cyan dye image forming layer unit, characterized in that in at least the blue recording yellow dye image forming layer unit silver bromoiodide emulsions having a grain iodide content of from 1 to 15 mole percent, based on total silver, form at least two emulsion layers, one of the emulsion layers overlying at least one other emulsion layer, and the overlying emulsion layer is a tabular grain emulsion layer in which the coefficient of variation of the tabular grain emulsion is less than 10 percent, based on the total grain population of the emulsion, the total grain population of said emulsion consists essentially of tabular grains having a mean thickness of less than 0.2 μm, and the vehicle is comprised of a gelatino-peptizer containing less than 30 micromoles per gram of methionine and a polyalkylene oxide block copolymer surfactant having a molecular weight in the range of from 760 to 16,000 satisfying the formula:

LAO1—HAO1—LAO1 where

LAO1 in each occurrence represents a terminal lipophilic alkylene oxide block unit containing at least six —$CH(CH_3)CH_2O$— repeating units and HAO1 represents a hydrophilic alkylene oxide block linking unit containing —$CH_2CH_2O$— repeating units forming 4 to 35 percent of the total surfactant molecular weight.

24. A multicolor photographic element capable of forming a viewable reversal dye image according to claim 23 further characterized in that the polyalkylene oxide block copolymer surfactant having a molecular weight in the range of from 1000 to 10,000, LAO1 in each occurrence contains at least seven—$CH(CH_3)CH_2O$— repeating units and HAO1 forms from 10 to 30 percent of the total surfactant molecular weight.

25. A multicolor photographic element capable of forming a viewable reversal dye image comprising a support and, coated on the support, a blue recording yellow dye image forming layer unit, a green recording magenta dye image forming layer unit, a red recording cyan dye image forming layer unit, characterized in that in at least the blue recording yellow dye image forming layer unit silver bromoiodide emulsions having a grain iodide content of from 1 to 15 mole percent, based on total silver, form at least two emulsion layers, one of the emulsion layers overlying at least one other emulsion layer, and the overlying emulsion layer is a tabular grain emulsion layer in which the coefficient of variation of the tabular grain emulsion is less than 10 percent, based on the total grain population of the emulsion, the total grain population of said emulsion consists essentially of tabular grains having a mean thickness of less than 0.2 μm, and the vehicle is comprised of a gelatino-peptizer containing at least 30 micromoles per gram of methionine and a polyalkylene oxide block copolymer surfactant having a molecular weight in the range of from 800 to 30,000 satisfying the formula:

HAO2—LAO2—HAO2 where

HAO2 in each occurrence represents a terminal hydrophilic alkylene oxide block unit and LAO2 represents a lipophilic alkylene oxide block linking unit, contains at least thirteen —$CH(CH_3)CH_2O$— repeating units, and accounts for from 15 to 95 percent of the total surfactant molecular weight.

26. A multicolor photographic element capable of forming a viewable reversal dye image according to claim 25 further characterized in that the polyalkylene oxide block copolymer surfactant has a molecular weight in the range of from 1000 to 20,000 and LAO2 accounts for from 20 to 90 percent of the total surfactant molecular weight.

27. A multicolor photographic element capable of forming a viewable reversal dye image comprising a support and, coated on the support, a blue recording yellow dye image forming layer unit, a green recording magenta dye image forming layer unit, a red recording cyan dye image forming layer unit, characterized in that in at least the blue recording yellow dye image forming layer unit silver bromoiodide emulsions having a grain iodide content of from 1 to 15 mole percent, based on total silver, form at least two emulsion layers, one of the emulsion layers overlying at least one other emulsion layer, and the overlying emulsion layer is a tabular grain emulsion layer in which the coefficient of variation of the tabular grain emulsion is less than 10 percent, based on the total grain population of the emulsion, the total grain population of said emulsion consists essentially of tabular grains having a mean thickness of less than 0.3 μm, and the vehicle is comprised of a gelatino-peptizer which contains less than 30 micromoles per gram of methionine and a polyalkylene oxide block copolymer surfactant having a molecular weight in the range of from 800 to 30,000 satisfying the formula:

HAO2—LAO2—HAO2 where

HAO2 in each occurrence represents a terminal hydrophilic alkylene oxide block unit and LAO2 represents a lipophilic alkylene oxide block linking unit, contains at least thirteen —$CH(CH_3)CH_2O$— repeating units, and accounts for from 15 to 95 percent of the total surfactant molecular weight.

28. A multicolor photographic element capable of forming a viewable reversal dye image according to claim 27 further characterized in that the polyalkylene oxide block copolymer surfactant has a molecular weight in the range of from 1000 to 20,000 and LAO2 represents 60 to 90 percent of the total surfactant molecular weight.

29. A photographic element capable of forming a viewable reversal dye image comprising a support and, coated on said support, at least one image forming layer unit, one of which is a blue recording yellow dye image forming unit containing in at least one layer a silver halide emulsion having a grain halide content of from 0 to 5 mole percent chloride, from 0.1 to 20 mole percent iodide, and from 80 to 99 mole percent bromide, based on total silver, characterized in that the at least one layer is a tabular grain emulsion layer in which the coefficient of variation of the tabular grain emulsion is less than 15 percent, based on the total grain population of the emulsion, and the total grain population of the tubular grain emulsion consists essentially of tabular grains having a mean thickness of less than 0.3 μm and a mean tabularity of greater than 25.

* * * * *